US007861788B2

(12) United States Patent
Tips et al.

(10) Patent No.: US 7,861,788 B2
(45) Date of Patent: Jan. 4, 2011

(54) CASING VALVES SYSTEM FOR SELECTIVE WELL STIMULATION AND CONTROL

(75) Inventors: Timothy R. Tips, Montgomery, TX (US); Alfred Curington, The Woodlands, TX (US)

(73) Assignee: Welldynamics, Inc., Spring, TX (US)

( * ) Notice: Subject to any disclaimer, the term of this patent is extended or adjusted under 35 U.S.C. 154(b) by 393 days.

(21) Appl. No.: 12/016,525

(22) Filed: Jan. 18, 2008

(65) Prior Publication Data

US 2009/0014168 A1 Jan. 15, 2009

(30) Foreign Application Priority Data

Jan. 25, 2007 (WO) ..... PCT/US2007/061031

(51) Int. Cl.
*E21B 34/10* (2006.01)

(52) U.S. Cl. ..... 166/319; 166/321

(58) Field of Classification Search ..... 166/319, 166/321, 65.1, 66.6, 242.2, 385, 313
See application file for complete search history.

(56) References Cited

U.S. PATENT DOCUMENTS

| | | | |
|---|---|---|---|
| 2,512,226 A | 6/1950 | Edwards | |
| 4,949,788 A | 8/1990 | Szarka et al. | |
| 4,967,845 A | 11/1990 | Shirk | |
| 5,872,876 A | 2/1999 | Kluth et al. | |
| 6,397,949 B1 | 6/2002 | Walker et al. | |
| 6,568,481 B2 | 5/2003 | Koehler et al. | |
| 6,659,186 B2 | 12/2003 | Patel | |
| 6,729,393 B2 * | 5/2004 | Vincent et al. | 166/177.4 |
| 6,761,219 B2 | 7/2004 | Snider et al. | |
| 7,267,172 B2 | 9/2007 | Hofman | |
| 7,273,106 B2 | 9/2007 | Huckabee et al. | |
| 7,387,165 B2 | 6/2008 | Lopez De Cardenas et al. | |
| 7,478,676 B2 | 1/2009 | East, Jr. et al. | |
| 7,604,055 B2 | 10/2009 | Richard et al. | |

(Continued)

FOREIGN PATENT DOCUMENTS

| | | |
|---|---|---|
| GB | 2320731 | 7/1998 |

(Continued)

OTHER PUBLICATIONS

Excape product brochure, 1 page (2000).

(Continued)

*Primary Examiner*—Hoang Dang
(74) *Attorney, Agent, or Firm*—Marlin R. Smith

(57) ABSTRACT

Casing valves for selective well stimulation and control. A well system includes at least one valve interconnected in a casing string operable via at least one line external to the casing string to selectively control fluid flow between an exterior and interior of the casing string, and the casing string, valve and line being cemented in a wellbore. A method of selectively stimulating a subterranean formation includes: positioning a casing string in a wellbore, the casing string including spaced apart valves operable via a line to selectively control fluid flow between an interior and exterior of the casing string; and for each of multiple intervals of the formation in sequence, stimulating the interval by opening a corresponding one of the valves, closing the remainder of the valves, and flowing a stimulation fluid from the casing string into the interval.

16 Claims, 12 Drawing Sheets

U.S. PATENT DOCUMENTS

| | | | | |
|---|---|---|---|---|
| 7,690,432 | B2 * | 4/2010 | Noske et al. | 166/319 |
| 2002/0112862 | A1 | 8/2002 | Patel | |
| 2003/0178203 | A1 | 9/2003 | Griffiths | |
| 2004/0020652 | A1 | 2/2004 | Campbell et al. | |
| 2004/0035578 | A1 | 2/2004 | Ross et al. | |
| 2004/0084189 | A1 | 5/2004 | Hosie et al. | |
| 2007/0272411 | A1 | 11/2007 | Lopez De Cardenas et al. | |
| 2009/0044944 | A1 | 2/2009 | Murray et al. | |
| 2009/0084553 | A1 | 4/2009 | Rytlewski et al. | |
| 2009/0139728 | A1 | 6/2009 | Schrader et al. | |

FOREIGN PATENT DOCUMENTS

| | | | |
|---|---|---|---|
| WO | 9737102 | A2 | 10/1997 |
| WO | 97/49894 | | 12/1997 |
| WO | 98/12417 | | 3/1998 |

OTHER PUBLICATIONS

Case History, "RapidMATRIX HZ Horizontal Acidizing System is Used Field Wide to Produce Excellent Results," 1 page (undated).
Case History, "StackFRAC HZ Horizontal Fracturing/Stimulation System Achieves Best in Field Results," 1 page, undated.
CBM Zone Monitoring, Packers Plus brochure, 1 page, undated.
Halliburton Drawing No. 00017600 (Oct. 12, 2005).
International Search Report and Written Opinion issued for International Patent Application No. PCT/US07/61031 dated Jan. 4, 2008 (12 pages).
Halliburton Drawing No. 00239025 (Feb. 21, 2006).
Halliburton Drawing No. 00254021 (Jul. 13, 2006).
Excape Completion Process Eccentric Centralizer product brochure, Turbeco, 2 pages (undated).
Halliburton product brochure, Cobra Frac Service, 2 pages (Aug. 2005).
Halliburton product brochure, "FracDoor Sliding Side-Door Circulation and Production Sleeve," 2 pages (Feb. 2006).
Halliburton product brochure, CobraMax Fracturing Service, 2 pages (May 2005).
Halliburton product brochure, "Delta Stim Sleeve," 2 pages (Feb. 2006).
Packers Plus product brochure. RapidMATRIX Multi-Stage Stimulation Systems, 4 pages (undated).
Rodgerson, J.L., et al., "External Casing Perforating Provides Optimal Treatment Coverage in Horizontal Pay," SPE 97175, 6 pages (2005).
Packers Plus product brochure, Vertical Cased Hole StackFRAC, 1 pages (undated).
Packers Plus product brochure, ZoneBoss Intelligent Well Systems, 1 page (undated).
Office Action issued Mar. 25, 2010, for U.S. Appl. No. 12/275,666, 17 pages.
Excape Completion Process, "Your Fastest Path to Profit," product brochure, Marathon Oil Co., BJ Services Co., & The Expo Group, 5 pages, dated 2004.
Garner, J.Jay, et al., "Casing-Conveyed Perforating System Presents a Unique Set of Drilling and Cementing Challenges: A Case History Study-Kenai Gas Field, Alaska," SPE 79877, 11 pages, dated 2003.
McDaniel, B.W., et al., "Review of Current Fracture Stimulation Techniques for Best Economics in Multilayer, Lower-Permeability Reservoirs," SPE 98025, 19 pages, dated 2005.
Packers Plus, "Stack Frac™ Multi-Stage Fracturing Systems," product brochure, 4 pages, undated.
International Preliminary Report on Patentability issued Aug. 6, 2009, for International Patent Application Serial No. PCT/US07/61031, 6 pages.
Office Action issued Aug. 18, 2010, for U.S. Appl. No. 12/275,666, 14 pages.

* cited by examiner

FIG.6
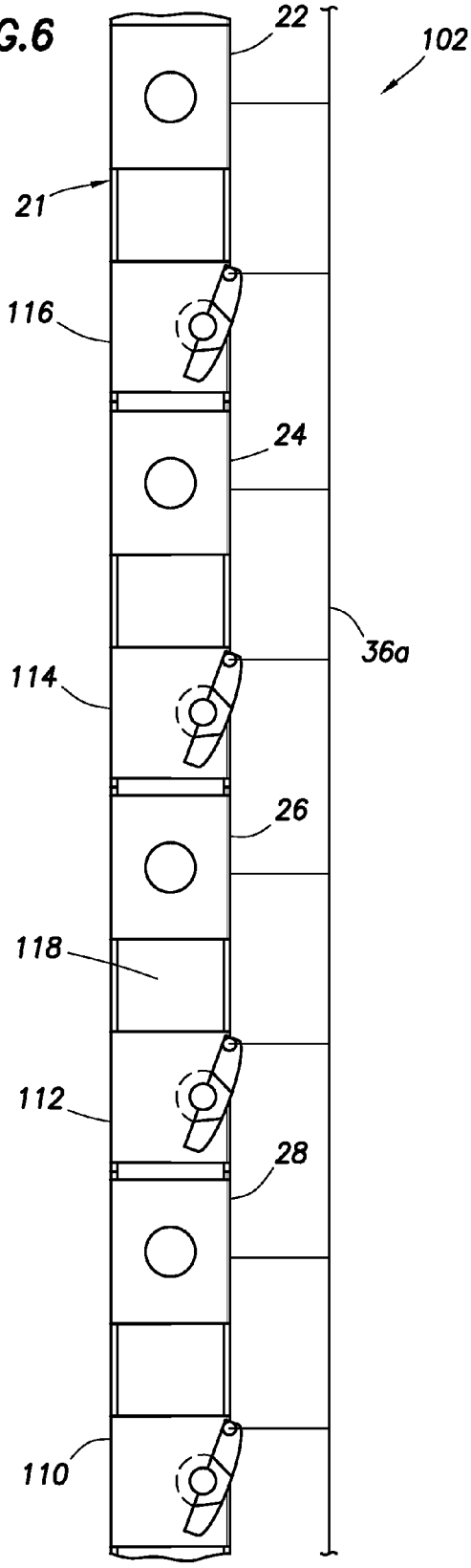
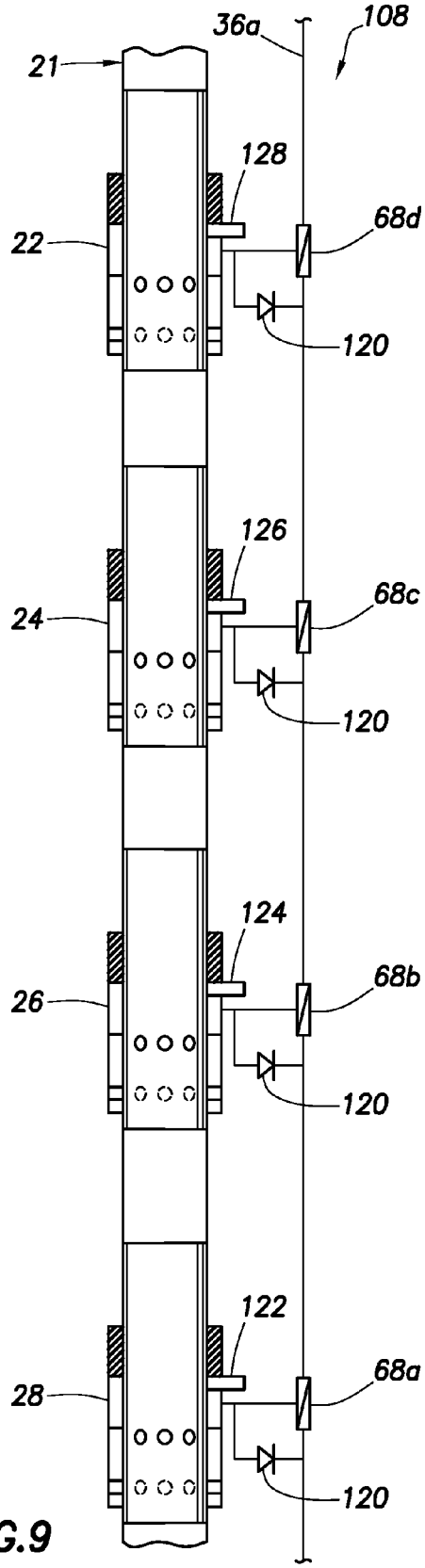
FIG.9

CASING VALVES SYSTEM FOR SELECTIVE WELL STIMULATION AND CONTROL

BACKGROUND

The present invention relates generally to equipment utilized and operations performed in conjunction with a subterranean well and, in an embodiment described herein, more particularly provides a well system with casing valves for selective well stimulation and control.

Several systems have been used in the past for selectively fracturing individual zones in a well. In one such system, a coiled tubing string is used to open and close valves in a casing string. In another system, balls are dropped into the casing string and pressure is applied to shift sleeves of valves in the casing string.

It will be appreciated that use of coiled tubing and balls dropped into the casing string obstruct the interior of the casing string. This reduces the flow area available for pumping stimulation fluids into the zone. Where the stimulation fluid includes an abrasive proppant, ball seats will likely be eroded by the fluid flow.

Furthermore, these prior systems do not facilitate convenient use of the valves in subsequent operations, such as during testing and production, in steamflood operations, etc. For example, the coiled tubing operated system requires costly and time-consuming intervention into the well to manipulate the valves, and the ball drop operated systems are either inoperable after the initial stimulation operations are completed, or require intervention into the well.

Therefore, it may be seen that improvements are needed in the art of selectively stimulating and controlling flow in a well.

SUMMARY

In carrying out the principles of the present invention, a well system and associated method are provided which solve at least one problem in the art. One example is described below in which the well system includes casing valves remotely operable via one or more lines, without requiring intervention into the casing, and without requiring balls to be dropped into, or pressure to be applied to, the casing. Another example is described below in which the lines and valves are cemented in a wellbore with the casing, and the valves are openable and closeable after the cementing operation.

In one aspect, a well system is provided which includes at least one valve interconnected in a casing string. The valve is operable via at least one line external to the casing string to thereby selectively permit and prevent fluid flow between an exterior and an interior of the casing string. The casing string, valve and line are cemented in a wellbore.

In another aspect, a method of selectively stimulating a subterranean formation is provided. The method includes the steps of: positioning a casing string in a wellbore intersecting the formation, the casing string including multiple spaced apart valves operable to selectively permit and prevent fluid flow between an interior and an exterior of the casing string, the valves being operable via at least one line connected to the valves; and for each of multiple intervals of the formation in sequence, stimulating the interval by opening a corresponding one of the valves, closing the remainder of the valves, and flowing a stimulation fluid from the interior of the casing string and into the interval.

In yet another aspect, a method of selectively stimulating a subterranean formation includes the steps of: providing first and second wellbores intersecting the formation; positioning a first tubular string in one of the first and second wellbores, the first tubular string including multiple spaced apart first valves operable to selectively permit and prevent fluid flow between an interior and an exterior of the first tubular string; and for each of multiple sets of one or more intervals of the formation, stimulating the interval set by opening a corresponding one of the first valves, flowing a stimulation fluid into the interval set, and in response receiving a formation fluid from the interval set into the second wellbore.

A valve for use in a tubular string in a subterranean well is also provided. The valve includes a sleeve having opposite ends, with the sleeve being displaceable between open and closed positions to thereby selectively permit and prevent flow through a sidewall of a housing. Pistons are at the ends of the sleeve. Pressure differentials applied to the pistons are operative to displace the sleeve between its open and closed positions.

In a further aspect, a method of selectively stimulating a subterranean formation includes the steps of:

positioning a first tubular string in a first wellbore intersecting the formation, the first tubular string including multiple spaced apart first valves operable to selectively permit and prevent fluid flow between an interior and an exterior of the first tubular string;

positioning a second tubular string in a second wellbore intersecting the formation, the second tubular string including multiple spaced apart second valves operable to selectively permit and prevent fluid flow between an interior and an exterior of the second tubular string; and for each of multiple intervals of the formation, stimulating the interval by opening a corresponding one of the first valves, flowing a stimulation fluid from the interior of the first tubular string and into the interval, opening a corresponding one of the second valves, and in response receiving a formation fluid from the interval into the interior of the second tubular string.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

BRIEF DESCRIPTION OF THE DRAWINGS

FIG. 6 is a schematic diagram of a first alternate hydraulic circuit for the well system of FIG. 1;

FIG. 9 is a schematic diagram of a fourth alternate hydraulic circuit for the well system of FIG. 1;

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
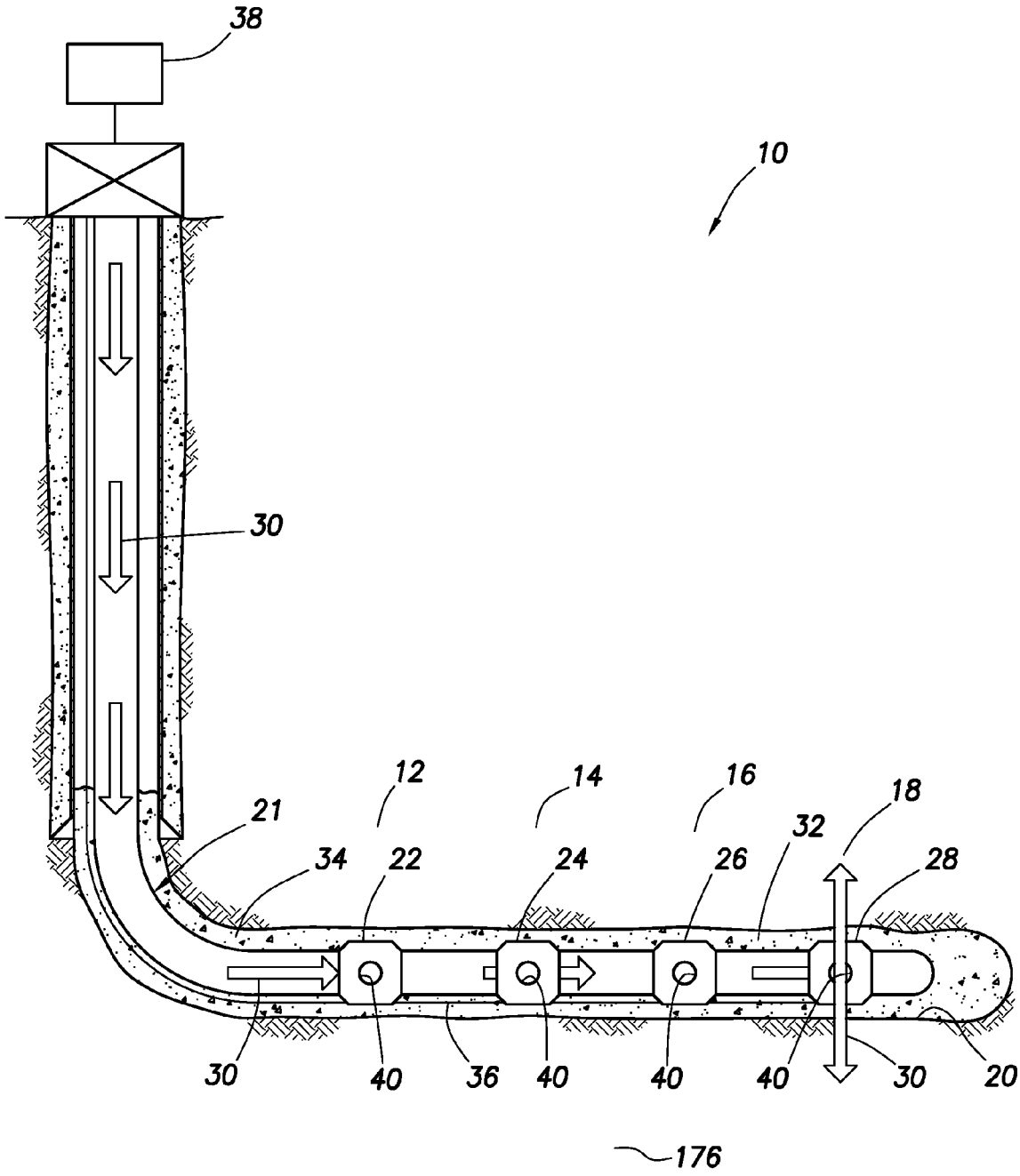
FIG. 1 is a schematic partially cross-sectional view of a well system and associated method embodying principles of the present invention.

Representatively illustrated in FIG. 1 is a well system 10 and associated method which embody principles of the present invention. The system 10 and method are used to selectively stimulate multiple sets of one or more intervals 12, 14, 16, 18 of a formation 176 intersected by a wellbore 20.

Each of the interval sets 12, 14, 16, 18 may include one or more intervals of the formation 176. As depicted in FIG. 1, there are four of the interval sets 12, 14, 16, 18, and the wellbore 20 is substantially horizontal in the intervals, but it should be clearly understood that any number of intervals may exist, and the wellbore could be vertical or inclined in any direction, in keeping with the principles of the invention.

A casing string 21 is installed in the wellbore 20. As used herein, the term "casing string" is used to indicate any tubular string which is used to form a protective lining for a wellbore. Casing strings may be made of any material, such as steel, polymers, composite materials, etc. Casing strings may be jointed, segmented or continuous. Typically, casing strings are sealed to the surrounding formation using cement or another hardenable substance (such as epoxies, etc.), or by using packers or other sealing materials, in order to prevent or isolate longitudinal fluid communication through an annulus formed between the casing string and the wellbore.

The casing string 21 depicted in FIG. 1 includes four valves 22, 24, 26, 28 interconnected therein. Thus, the valves 22, 24, 26, 28 are part of the casing string 21, and are longitudinally spaced apart along the casing string.

Preferably each of the valves 22, 24, 26, 28 corresponds to one of the interval sets 12, 14, 16, 18 and is positioned in the wellbore 20 opposite the corresponding interval. However, it should be understood that any number of valves may be used in keeping with the principles of the invention, and it is not necessary for a single valve to correspond to, or be positioned opposite, a single interval. For example, multiple valves could correspond to, and be positioned opposite, a single interval, and a single valve could correspond to, and be positioned opposite, multiple intervals.

Each of the valves 22, 24, 26, 28 is selectively operable to permit and prevent fluid flow between an interior and exterior of the casing string 21. The valves 22, 24, 26, 28 could also control flow between the interior and exterior of the casing string 21 by variably choking or otherwise regulating such flow.

With the valves 22, 24, 26, 28 positioned opposite the respective interval sets 12, 14, 16, 18 as depicted in FIG. 1, the valves may also be used to selectively control flow between the interior of the casing string 21 and each of the interval sets. In this manner, each of the interval sets 12, 14, 16, 18 may be selectively stimulated by flowing stimulation fluid 30 through the casing string 21 and through any of the open valves into the corresponding interval sets.

As used herein, the term "stimulation fluid" is used to indicate any fluid, or combination of fluids, which is injected into a formation or interval set to increase a rate of fluid flow through the formation or interval set. For example, a stimulation fluid might be used to fracture the formation, to deliver proppant to fractures in the formation, to acidize the formation, to heat the formation, or to otherwise increase the mobility of fluid in the formation. Stimulation fluid may include various components, such as gels, proppants, breakers, etc.

As depicted in FIG. 1, the stimulation fluid 30 is being delivered to the interval set 18 via the open valve 28. In this manner, the interval set 18 can be selectively stimulated, such as by fracturing, acidizing, etc.

The interval set 18 is isolated from the interval set 16 in the wellbore 20 by cement 32 placed in an annulus 34 between the casing string 21 and the wellbore. The cement 32 prevents the stimulation fluid 30 from being flowed to the interval set 16 via the wellbore 20 when stimulation of the interval set 16 is not desired. The cement 32 isolates each of the interval sets 12, 14, 16, 18 from each other in the wellbore 20.

As used herein, the term "cement" is used to indicate a hardenable sealing substance which is initially sufficiently fluid to be flowed into a cavity in a wellbore, but which subsequently hardens or "sets up" so that it seals off the cavity. Conventional cementitious materials harden when they are hydrated. Other types of cements (such as epoxies or other polymers) may harden due to passage of time, application of heat, combination of certain chemical components, etc.

Each of the valves 22, 24, 26, 28 has one or more openings 40 for providing fluid communication through a sidewall of the valve. It is contemplated that the cement 32 could prevent flow between the openings 40 and the interval sets 12, 14, 16, 18 after the cement has hardened, and so various measures may be used to either prevent the cement from blocking this flow, or to remove the cement from the openings, and from between the openings and the interval sets. For example, the cement 32 could be a soluble cement (such as an acid soluble cement), and the cement in the openings 40 and between the openings and the interval sets 12, 14, 16, 18 could be dissolved by a suitable solvent in order to permit the stimulation fluid 30 to flow into the interval sets. The stimulation fluid 30 itself could be the solvent.

In the well system 10, the valve 28 is opened after the cementing operation, that is, after the cement 32 has hardened to seal off the annulus 34 between the interval sets 12, 14, 16, 18. The stimulation fluid 30 is then pumped through the casing string 21 and into the interval set 18.

The valve 28 is then closed, and the next valve 26 is opened. The stimulation fluid 30 is then pumped through the casing string 21 and into the interval set 16.

The valve 26 is then closed, and the next valve 24 is opened. The stimulation fluid 30 is then pumped through the casing string 21 and into the interval set 14.

The valve 24 is then closed, and the next valve 22 is opened. The stimulation fluid 30 is then pumped through the casing string 21 and into the interval set 12.

Thus, the valves 22, 24, 26, 28 are sequentially opened and then closed to thereby permit sequential stimulation of the corresponding interval sets 12, 14, 16, 18. Note that the valves 22, 24, 26, 28 may be opened and closed in any order, in keeping with the principles of the invention.

In an important feature of the well system 10 and associated method, the valves 22, 24, 26, 28 may be opened and closed as many times as is desired, the valves may be opened and closed after the cementing operation, the valves may be opened and closed without requiring any intervention into the casing string 21, the valves may be opened and closed without installing any balls or other plugging devices in the casing string, and the valves may be opened and closed without applying pressure to the casing string.

Instead, the valves 22, 24, 26, 28 are selectively and sequentially operable via one or more lines 36 which are preferably installed along with the casing string 21. In addition, the lines 36 are preferably installed external to the casing string 21, so that they do not obstruct the interior of the casing string, but this is not necessary in keeping with the principles of the invention. Note that, as depicted in FIG. 1, the lines 36 are cemented in the annulus 34 when the casing string 21 is cemented in the wellbore 20.

The lines 36 are connected to each of the valves 22, 24, 26, 28 to control operation of the valves. Preferably the lines 36 are hydraulic lines for delivering pressurized fluid to the valves 22, 24, 26, 28, but other types of lines (such as electrical, optical fiber, etc.) could be used if desired.

The lines 36 are connected to a control system 38 at a remote location (such as the earth's surface, sea floor, floating rig, etc.). In this manner, operation of the valves 22, 24, 26, 28 can be controlled from the remote location via the lines 36, without requiring intervention into the casing string 21.

After the stimulation operation, it may be desired to test the interval sets 12, 14, 16, 18 to determine, for example, post-stimulation permeability, productivity, injectivity, etc. An individual interval set can be tested by opening its corresponding one of the valves 22, 24, 26, 28 while the other valves are closed.

Formation tests, such as buildup and drawdown tests, can be performed for each interval set 12, 14, 16, 18 by selectively opening and closing the corresponding one of the valves 22, 24, 26, 28 while the other valves are closed. Instruments, such as pressure and temperature sensors, may be included with the casing string 21 to perform downhole measurements during these tests.

The valves 22, 24, 26, 28 may also be useful during production to control the rate of production from each interval set. For example, if interval set 18 should begin to produce water, the corresponding valve 28 could be closed, or flow through the valve could be choked, to reduce the production of water.

If the well is an injection well, the valves 22, 24, 26, 28 may be useful to control placement of an injected fluid (such as water, gas, steam, etc.) into the corresponding interval sets 12, 14, 16, 18. A waterflood, steamfront, oil-gas interface, or other injection profile may be manipulated by controlling the opening, closing or choking of fluid flow through the valves 22, 24, 26, 28.

Figure 2:
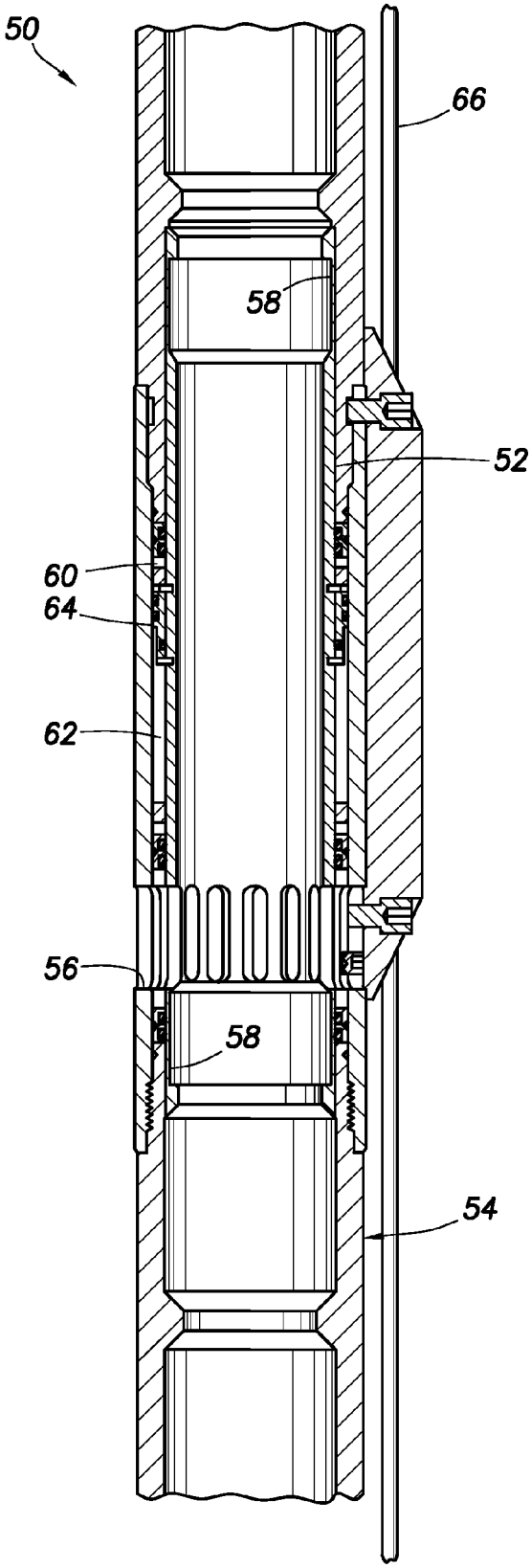
FIG. 2 is a schematic cross-sectional view of a valve which may be used in the well system and method of FIG. 1.

Referring additionally now to FIG. 2, a valve 50 which may be used for any of the valves 22, 24, 26, 28 in the well system 10 is representatively illustrated. The valve 50 may be used in other well systems, without departing from the principles of the invention.

The valve 50 is of the type known to those skilled in the art as a sliding sleeve valve, in that it includes a sleeve 52 which is reciprocably displaceable within a housing assembly 54 to thereby selectively permit and prevent flow through openings 56 formed through a sidewall of the housing assembly. Profiles 58 formed internally on the sleeve 52 may be used to shift the sleeve between its open and closed positions, for example, by using a shifting tool conveyed by wireline or coiled tubing.

However, when used in the well system 10, the sleeve 52 is preferably displaced by means of pressure applied to chambers 60, 62 above and below a piston 64 on the sleeve. Pressurized fluid is delivered to the chambers 60, 62 via hydraulic lines 66 connected to the valve 50. In the well system 10, the lines 36 would correspond to the lines 66 connected to the valve 50.

In one embodiment, a flow control device 68 is interconnected between one of the lines 66 and the chamber 62, so that a predetermined pressure level in the line is required to permit fluid communication between the line and the chamber, to thereby allow the sleeve 52 to displace upwardly and open the valve 50. The flow control device 68 is representatively illustrated in FIGS. 3A & B.

Figure 3A:
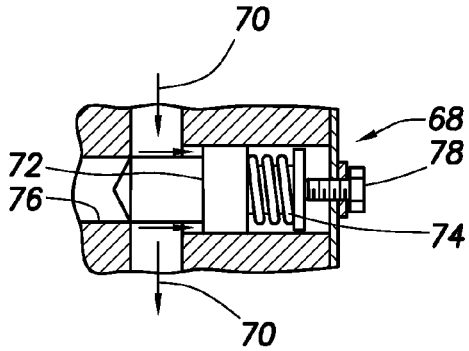
FIGS. 3A & B are schematic cross-sectional views of a flow control device which may be used in conjunction with the valve of FIG. 2.

Pressure delivered via the control line 66 is indicated in FIG. 3A by arrows 70. This pressure acts on a piston 72 of the device 68. If the pressure 70 is below the predetermined pressure level, a spring 74 maintains a port 76 closed. The port 76 is in communication with the chamber 62 of the valve 50.

Note that the pressure 70 is communicated through the device 68, whether the port 76 is open or closed, so that the pressure can be delivered simultaneously to multiple valves 50 connected to the line 66.

Figure 3B:
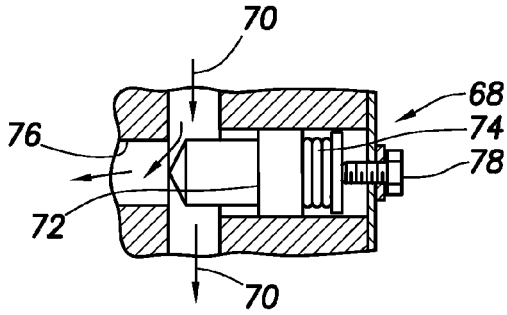

In FIG. 3B, the device 68 is depicted after the pressure 70 has been increased to the predetermined level. The piston 72 has now displaced to open the port 76, and the pressure 70 is now communicated to the chamber 62. The pressure 70 in the chamber 62 can now act on the piston 64 to displace the sleeve 52 upward and open the valve 50.

Of course, an appropriate pressure differential must exist across the piston 64 in order for the sleeve 52 to be displaced upward. For this purpose, the upper chamber 60 may be connected to another pressure source, such as the interior of the casing string 21, an atmospheric or otherwise pressurized chamber, another one of the lines 66, etc.

The predetermined pressure at which the port 76 is opened may be adjusted by means of an adjustment mechanism 78 (depicted in FIGS. 3A & B as a threaded screw or bolt) which varies the force exerted on the piston 72 by the spring 74. Thus, the valve 50 may be configured to operate at any desired pressure. Furthermore, if multiple valves 50 are used (such as the valves 22, 24, 26, 28 in the well system 10), each valve may be configured to operate at a different pressure, thereby permitting selective operation of each valve.

Figure 4:
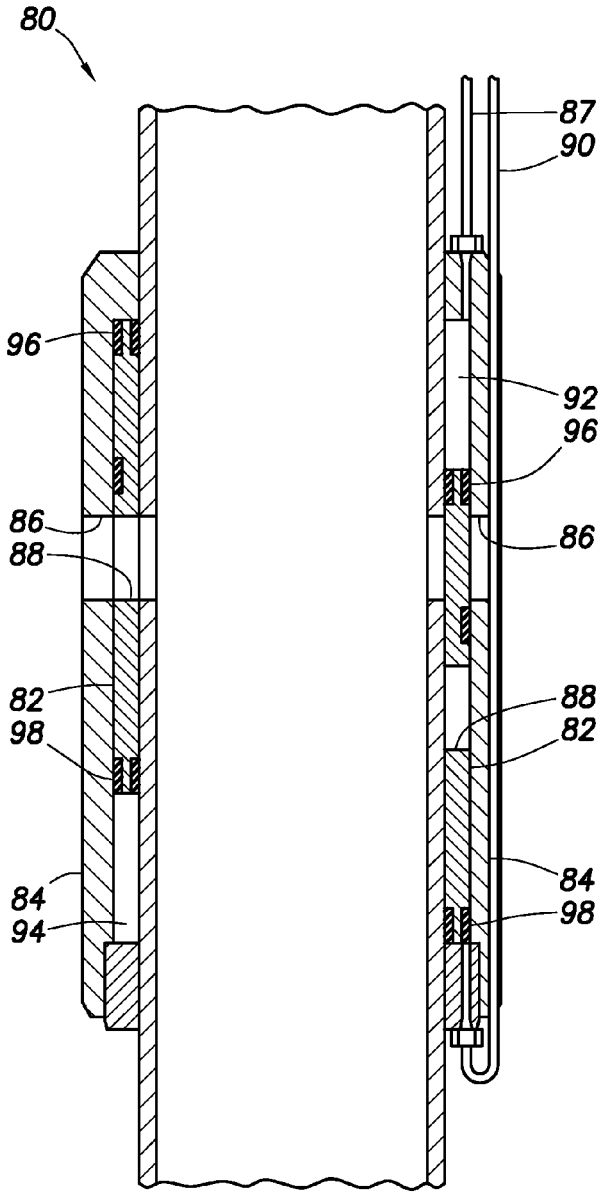
FIG. 4 is a schematic cross-sectional view of a first alternate construction of a valve which may be used in the well system and method of FIG. 1.

Another valve 80 which may be used for any of the valves 22, 24, 26, 28 in the well system 10 is representatively illustrated in FIG. 4. The valve 80 may be used in other well systems in keeping with the principles of the invention.

The valve 80 is also a sliding sleeve type of valve, since it includes a sleeve 82 reciprocably displaceable relative to a housing assembly 84 to thereby selectively permit and prevent flow through openings 86 formed through a sidewall of the housing assembly. However, the valve 80 is specially constructed for use in well systems and methods (such as the well system 10 and method of FIG. 1) in which the valve is to be operated after being cemented in a wellbore.

Specifically, openings 88 formed through a sidewall of the sleeve 82 are isolated from the interior and exterior of the valve 80 where cement is present during the cementing operation. The valve 80 is closed during the cementing operation, as depicted on the right-hand side of FIG. 4.

When it is desired to open the valve 80, the sleeve 82 is displaced upward, thereby aligning the openings 86, 88 and permitting fluid communication between the interior and exterior of the housing assembly 84. The open position of the sleeve 82 is depicted on the left-hand side of FIG. 4.

The sleeve 82 is displaced in the housing assembly 84 by means of pressure delivered via lines 87, 90 connected to the valve 80. The line 87 is in communication with a chamber 92, and the line 90 is in communication with a chamber 94, in the housing assembly 84.

Pistons 96, 98 on the sleeve 82 are exposed to pressure in the respective chambers 92, 94. When pressure in the chamber 94 exceeds pressure in the chamber 92, the sleeve 82 is biased by this pressure differential to displace upwardly to its open position. When pressure in the chamber 92 exceeds pressure in the chamber 94, the sleeve 82 is biased by this pressure differential to displace downwardly to its closed position.

Note that, when the sleeve 82 displaces between its open and closed positions (in either direction), the sleeve is displacing into one of the chambers 92, 94, which are filled with clean fluid. Thus, no debris, sand, cement, etc. has to be displaced when the sleeve 82 is displaced.

This is true even after the valve 80 has been cemented in the wellbore 20 in the well system 10. Although cement may enter the openings 86 in the outer housing 84 when the sleeve 82 is in its closed position, this cement does not have to be displaced when the sleeve is displaced to its open position.

An additional beneficial feature of the valve 80 is that the chambers 92, 94 and pistons 96, 98 are positioned straddling the openings 86, 88, so that a compact construction of the valve is achieved. For example, the valve 80 can have a reduced wall thickness and greater flow area as compared to other designs. This provides both a functional and an economic benefit.

When the valve 80 is used in the well system 10, the lines 87, 90 would correspond to the lines 36. Multiple valves 80 may be used for the valves 22, 24, 26, 28, and flow control devices (such as the flow control device 68 of FIGS. 3A & B) may be used to provide for selectively opening and closing the valves.

Figure 5:
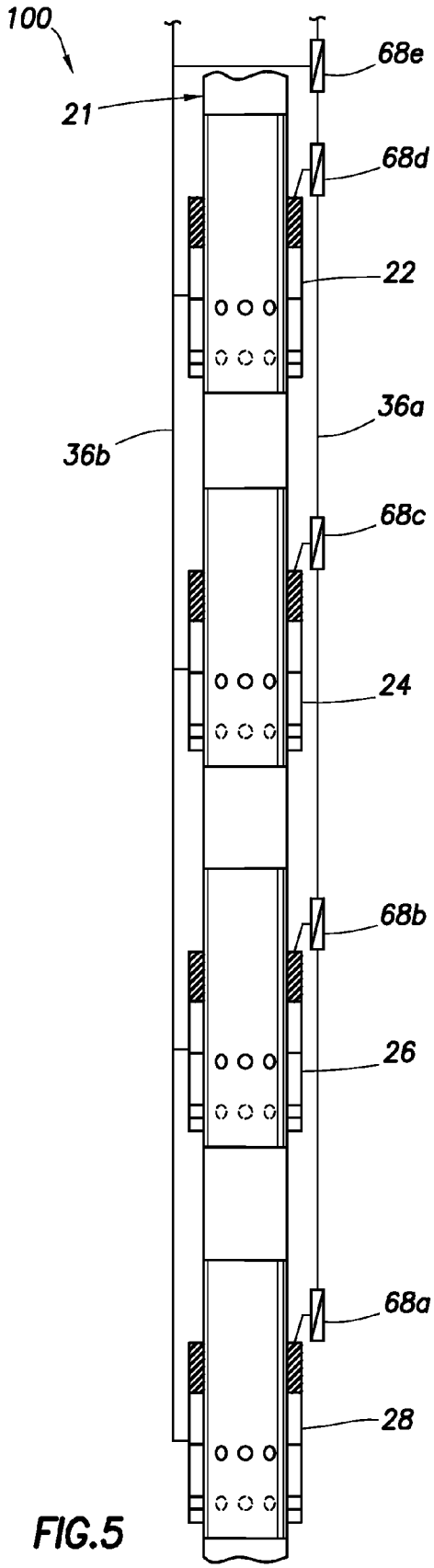
FIG. 5 is a schematic hydraulic circuit diagram for the well system of FIG. 1.

Referring additionally now to FIG. 5, a diagram of a hydraulic circuit 100 is representatively illustrated for the well system 10. The hydraulic circuit 100 may be used for other well systems in keeping with the principles of the invention.

As depicted in FIG. 5, the valves 22, 24, 26, 28 are each connected to two of the lines 36 (indicated in FIG. 5 as lines 36*a*, 36*b*). Flow control devices 68 (indicated in FIG. 5 as flow control devices 68*a*, 68*b*, 68*c*, 68*d*) are interconnected between the line 36*a* and each of the valves 22, 24, 26, 28.

If the valve 50 of FIG. 2 is used for the valves 22, 24, 26, 28, then the line 36*b* is connected to the chambers 60 of the valves, and the flow control devices 68*a-d* are connected to the respective chambers 62 of the valves. If the valve 80 of FIG. 4 is used for the valves 22, 24, 26, 28, then the line 36*b* is connected to the chambers 92 of the valves, and the flow control devices 68*a-d* are connected to the respective chambers 94 of the valves.

When the valves 22, 24, 26, 28 are installed with the casing string 21, all of the valves are preferably closed. This facilitates circulation through the casing string 21 during the installation and cementing operations.

The flow control devices 68*a-d* are set to open at different pressures. For example, the device 68*a* could be set to open at 1500 psi, the device 68*b* could be set to open at 2000 psi, the device 68*c* could be set to open at 2500 psi, and the device 68*d* could be set to open at 3000 psi. Of course, other opening pressures could be used, as desired.

To open the valve 28, pressure in the line 36*a* is increased to at least the set opening pressure for the device 68*a*, and the valve opens in response. To close the valve 28, the pressure in the line 36*a* is released and pressure is applied to the line 36*b*, until a sufficient differential pressure from the line 36*b* to the line 36*a* is achieved to open the device 68*a*.

To open the valve 26, pressure in the line 36*a* is increased to at least the set opening pressure for the device 68*b*, and the valve opens in response. Note that, if the set opening pressure for the device 68*b* is greater than the set opening pressure for the device 68*a*, both of the valves 26, 28 will open.

In that case, after the pressure in the line 36*a* has been increased to at least the set opening pressure for the device 68*b*, the pressure is released from the line 36*a*, and then sufficient pressure is applied to the line 36*b* to close the valve 28 as described above. To close the valve 26, increased pressure is applied to the line 36*b*, until a sufficient differential pressure from the line 36*b* to the line 36*a* is achieved to open the device 68*b*.

Similar procedures are used to open and close the valves 22 and 24. Assuming the set opening pressures for the devices 68*a-d* given above, an exemplary series of steps for sequentially opening and closing the valves 22-28 would be as follows:

1. increase pressure in line 36*a* to greater than 1500 psi (but less than 2000 psi) to open valve 28; then release the pressure from line 36*a;*

2. increase pressure in line 36*a* to greater than 2000 psi (but less than 2500 psi) to open valve 26; then release the pressure from line 36*a*; and then increase pressure in line 36*b* sufficiently to close valve 28;

3. increase pressure in line 36*a* to greater than 2500 psi (but less than 3000 psi) to open valves 24, 26, 28; then release the pressure from line 36*a*; and then increase pressure in line 36*b* sufficiently to close valves 26, 28; and 4. increase pressure in line 36*a* to greater than 3000 psi to open valves 22, 24, 26, 28; then release the pressure from line 36*a*; and then increase pressure in line 36*b* sufficiently to close valves 24, 26, 28.

It will be readily appreciated that the result of step 1 is that valve 28 is opened and the other valves 22, 24, 26 are closed (at which point the interval set 18 may be selectively stimulated, tested, produced, injected into, etc.), the result of step 2 is that valve 26 is opened and the other valves 22, 24, 28 are closed (at which point the interval set 16 may be selectively stimulated, tested, produced, injected into, etc.), the result of step 3 is that the valve 24 is opened and the other valves 22, 26, 28 are closed (at which point the interval set 14 may be selectively stimulated, tested, produced, injected into, etc.), and the result of step 4 is that valve 22 is opened and the other valves 24, 26, 28 are closed (at which point the interval set 12 may be selectively stimulated, tested, produced, injected into, etc.). Thus, the valves 22, 24, 26, 28 may be sequentially and selectively opened by manipulation of pressure on only two lines 36*a*, 36*b*, thereby permitting selective and sequential fluid communication between the interior of the casing string 21 and each of the interval sets 12, 14, 16, 18.

If the valve 50 is used for the valves 22, 24, 26, 28, and the control system 38 becomes inoperable or unavailable, or for another reason pressurized fluid cannot be (or is not desired to be) subsequently delivered via the lines 36 to operate the valves, then the hydraulic system can be disabled by increasing pressure in the line 36*a* to at least the set opening pressure for another flow control device 68*e*. The set opening pressure for the device 68*e* is preferably greater than the set opening pressures of all of the other devices 68*a-d*.

When the device 68*e* is opened, fluid communication is provided between the lines 36*a*, 36*b*. Unlike the devices 68*a-d*, the device 68*e* does not reclose once opened.

In this manner, the sleeves of the valves 50 may be shifted using a shifting tool conveyed through the casing string 21 and engaged with the profiles 58. Communication between the lines 36*a*, 36*b* via the device 68*e* permits the pistons 64 to displace by transferring fluid between the chambers 60, 62.

Alternate diagrams for hydraulic circuits 102, 104, 106, 108 are representatively illustrated in FIGS. 6-9. As with the hydraulic circuit 100 described above, these alternate hydraulic circuits 102, 104, 106, 108 provide for selective and sequential opening and closing of the valves 22, 24, 26, 28.

It should be clearly understood, however, that these are merely examples of hydraulic circuits which may be used to accomplish the objectives of operating the valves 22, 24, 26, 28 in well systems such as the well system 10 described above. A person skilled in the art will recognize that a large variety of hydraulic circuits may be used to operate multiple valves, including many hydraulic circuits which permit the valves to the selectively and sequentially opened and closed.

The hydraulic circuit 102 of FIG. 6 uses only a single line 36*a* to open each of the valves 22, 24, 26, 28. In addition, the line 36*a* is used to close each of valves 110, 112, 114, 116 positioned below the respective valves 28, 26, 24, 22 in the casing string 21.

In this alternate embodiment, the valves 22, 24, 26, 28, 110, 112, 114, 116 are operable between their open and closed configurations in response to pressure applied to the single line 36*a*. For example, the valves 22, 24, 26, 28, 11, 112, 114, 116 may be biased toward an open or closed configuration by a biasing device, such as a spring or chamber of compressed gas.

When pressure applied to the line 36*a* results in a force greater than the biasing force exerted by the biasing device, the valve is operated to the other of its open or closed configurations. The pressure at which the valve is operated between its open and closed configurations may be varied by varying the biasing force exerted by the biasing device.

The valves 110, 112, 114, 116 are similar to conventional safety valves for selectively permitting and preventing flow through a tubular string in a well.

However, conventional safety valves are typically designed to fail closed (i.e., they close when sufficient pressure is not maintained in a control line connected to the valve).

The valves 110, 112, 114, 116 are instead designed to close when sufficient pressure is applied to the line 36*a*. The valves 110, 112, 114, 116 are set to close when different pressures are applied to the line 36*a*. If sufficient pressure is not applied to the line 36*a*, the valves 110, 112, 114, 116 are biased open. When each of the valves 110, 112, 114, 116 is closed, fluid communication through an internal flow passage 118 of the casing string 21 is prevented at the valve.

Preferably, the valves 28, 110 are set to operate at the same pressure, the valves 26, 112 are set to operate at the same pressure, the valves 24, 114 are set to operate at the same pressure, and the valves 22, 116 are set to operate at the same pressure. For example, the valves 28, 110 could be set to operate at 1500 psi, the valves 26, 112 could be set to operate at 2000 psi, the valves 24, 114 could be set to operate at 2500 psi, and the valves 22, 116 could be set to operate at 3000 psi.

Assuming these operating pressures, a series of steps for selectively and sequentially operating the valves 22, 24, 26, 28, 110, 112, 114, 116 could be as follows:

1. increase pressure in the line 36*a* to greater than 1500 psi (but less than 2000 psi) to thereby close valve 110 and open valve 28;

2. increase pressure in the line 36*a* to greater than 2000 psi (but less than 2500 psi) to thereby close valve 112 and open valve 26;

3. increase pressure in the line 36*a* to greater than 2500 psi (but less than 3000 psi) to thereby close valve 114 and open valve 24; and 4. increase pressure in the line 36*a* to greater than 3000 psi to thereby close valve 116 and open valve 22.

It will be readily appreciated that the result of step 1 is that valves 28, 112, 114, 116 are open and the other valves 22, 24, 26, 110 are closed (at which point the interval set 18 may be selectively stimulated, tested, produced, injected into, etc.), the result of step 2 is that valves 26, 28, 114, 116 are open and the other valves 22, 24, 110, 112 are closed (at which point the interval set 16 may be selectively stimulated, tested, produced, injected into, etc.), the result of step 3 is that valves 24, 26, 28, 116 are open and the other valves 22, 110, 112, 114 are closed (at which point the interval set 14 may be selectively stimulated, tested, produced, injected into, etc.), and the result of step 4 is that valves 22, 24, 26, 28 are open and the other valves 110, 112, 114, 116 are closed (at which point the interval set 12 may be selectively stimulated, tested, produced, injected into, etc.). Thus, the valves 22, 24, 26, 28 may be sequentially and selectively opened and the valves 110, 112, 114, 116 may be sequentially and selectively closed by manipulation of pressure on only one line 36*a*, thereby permitting selective and sequential fluid communication between the interior of the casing string 21 and each of the interval sets 12, 14, 16, 18.

Figure 7:
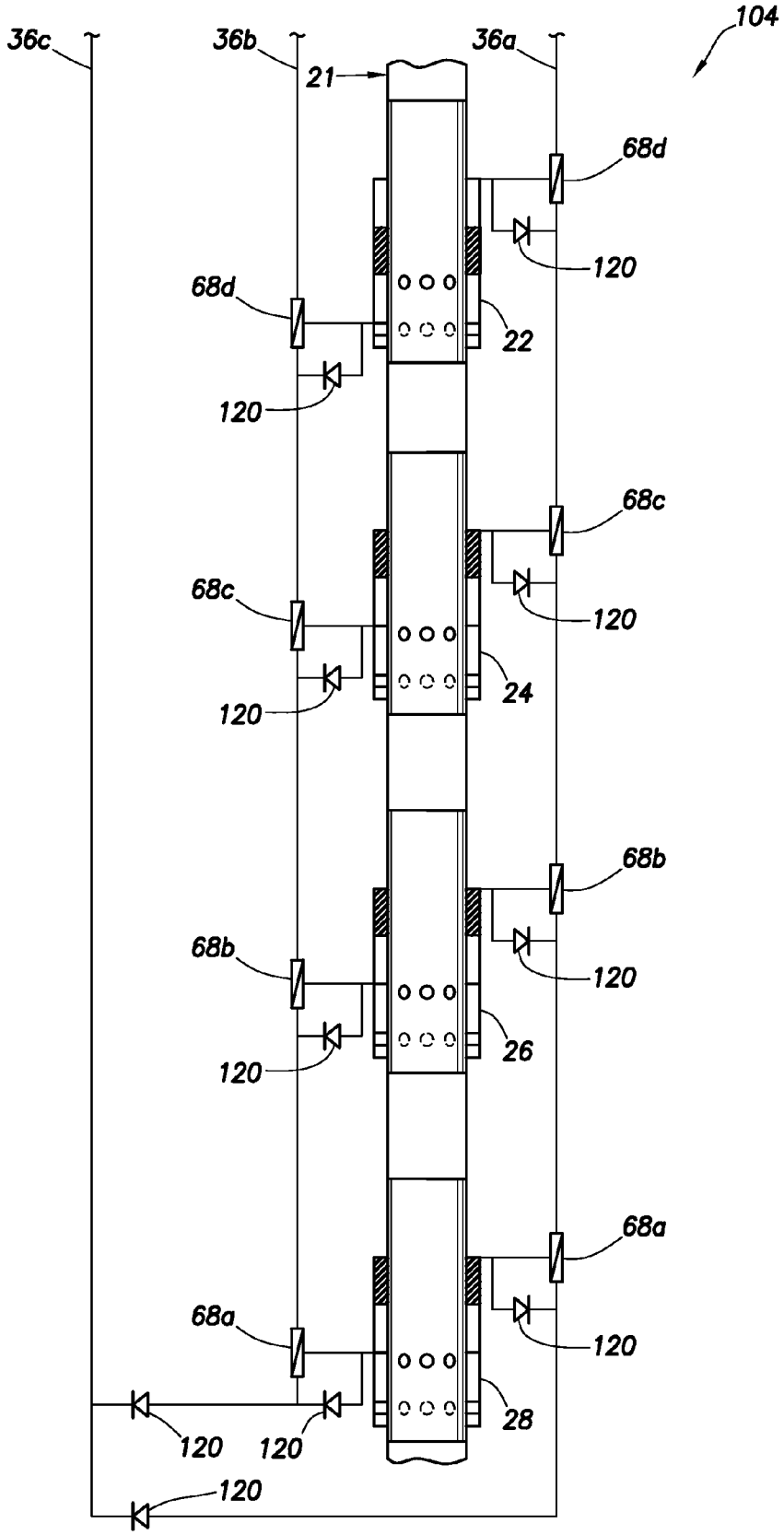
FIG. 7 is a schematic diagram of a second alternate hydraulic circuit for the well system of FIG. 1.

The hydraulic circuit 104 of FIG. 7 is similar in some respects to the hydraulic circuit 100 of FIG. 5, in that the devices 68*a-d* are used to control fluid communication between the line 36*a* and the valves 22, 24, 26, 28 to selectively open the valves. In the hydraulic circuit 104 of FIG. 7, additional devices 68*a-d* are also used to control fluid communication between the line 36*b* and the valves 22, 24, 26, 28 to selectively close the valves.

An additional line 36*c* is provided as a return or balance line. Each time one of the other lines 36*a*, 36*b* is used to operate one or more of the valves 22, 24, 26, 28, fluid is returned to the remote location via the line 36*c*. Check valves 120 ensure proper direction of flow between the lines 36*a-c* and valves 22, 24, 26, 28.

Assuming the set opening pressures for the devices 68*a-d* given above, an exemplary series of steps for sequentially opening and closing the valves 22-28 would be as follows:

1. increase pressure in line 36*a* to greater than 1500 psi (but less than 2000 psi) to open valve 28; then release the pressure from line 36*a;*

2. increase pressure in line 36*a* to greater than 2000 psi (but less than 2500 psi) to open valve 26; then release the pressure from line 36*a*; then increase pressure in line 36*b* to greater than 1500 psi (but less than 2000 psi) to close valve 28; then release the pressure from line 36*b;*

3. increase pressure in line 36*a* to greater than 2500 psi (but less than 3000 psi) to open valves 24, 26, 28; then release the pressure from line 36*a*; then increase pressure in line 36*b* to greater than 2000 psi (but less than 2500 psi) to close valves 26, 28; then release the pressure from line 36*b;*

4. increase pressure in line 36*a* to greater than 3000 psi to open valves 22, 24, 26, 28; then release the pressure from line 36*a*; and then increase pressure in line 36*b* greater than 2500 psi (but less than 3000 psi) to close valves 24, 26, 28.

It will be readily appreciated that the result of step 1 is that valve 28 is opened and the other valves 22, 24, 26 are closed (at which point the interval set 18 may be selectively stimulated, tested, produced, injected into, etc.), the result of step 2 is that valve 26 is opened and the other valves 22, 24, 28 are closed (at which point the interval set 16 may be selectively stimulated, tested, produced, injected into, etc.), the result of step 3 is that the valve 24 is opened and the other valves 22, 26, 28 are closed (at which point the interval set 14 may be selectively stimulated, tested, produced, injected into, etc.), and the result of step 4 is that valve 22 is opened and the other valves 24, 26, 28 are closed (at which point the interval set 12 may be selectively stimulated, tested, produced, injected into, etc.). Thus, the valves 22, 24, 26, 28 may be sequentially and selectively opened by manipulation of pressure on only two lines 36*a*, 36*b*, thereby permitting selective and sequential fluid communication between the interior of the casing string 21 and each of the interval sets 12, 14, 16, 18.

Figure 8:
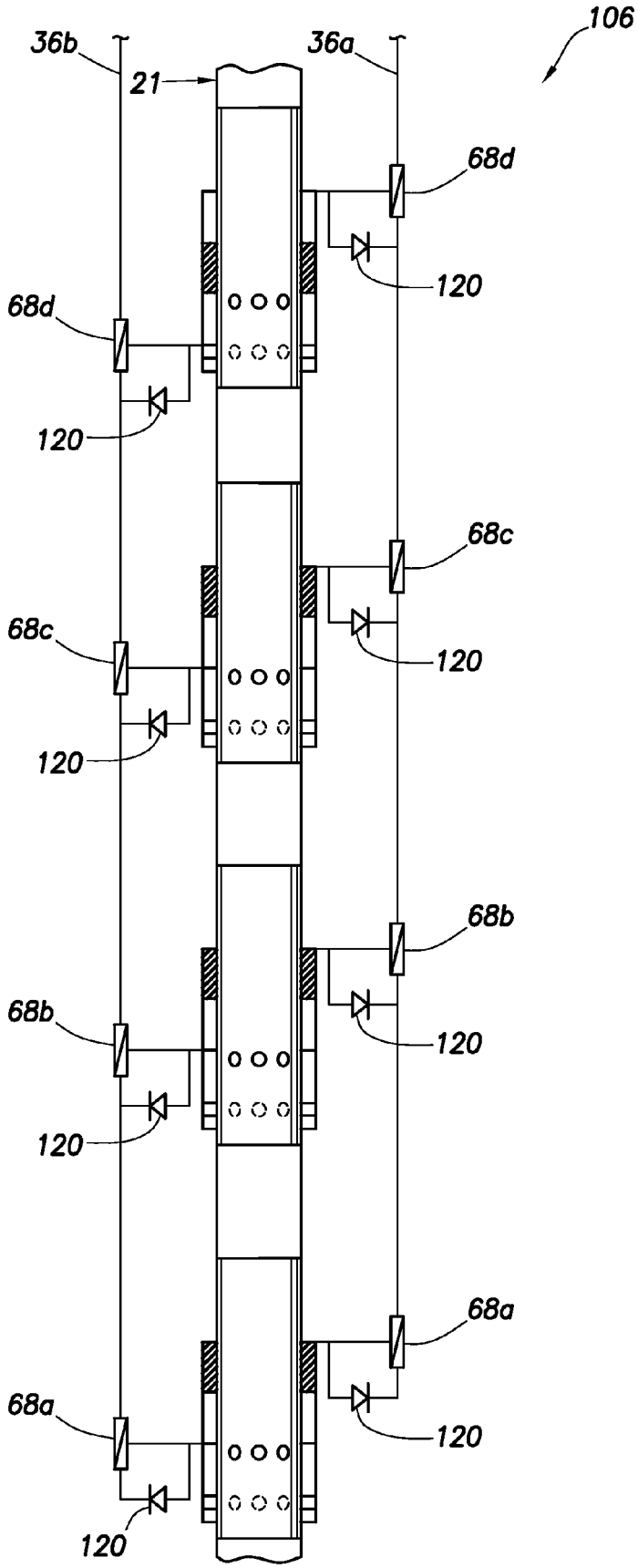
FIG. 8 is a schematic diagram of a third alternate hydraulic circuit for the well system of FIG. 1.

The hydraulic circuit 108 of FIG. 8 is somewhat similar to the hydraulic circuit 106 of FIG. 7 in that the devices 68*a-d* are used between each of the lines 36*a*, 36*b* and the valves 22, 24, 26, 28. However, a separate return or balance line 36*c* is not used in the hydraulic circuit 108 of FIG. 8.

Instead, fluid delivered to any of the valves 22, 24, 26, 28 via one of the lines 36*a*, 36*b* results in a return of fluid via the other line. That is, each of the lines 36*a*, 36*b* acts as a return or balance line for the other line. Otherwise, operation of the hydraulic circuit 108 is the same as operation of the hydraulic circuit 106.

In the hydraulic circuit 108 of FIG. 9, each of the valves 22, 24, 26, 28 is designed to fail open, i.e., a biasing device of each valve biases it toward an open configuration. However, when the valves 22, 24, 26, 28 are initially installed with the casing string 21, the valves are held in their closed configurations, for example, using shear devices 122, 124, 126, 128.

The shear devices 122, 124, 126, 128 are designed to require different pressures applied to the line 36*a* in order to allow the respective valves 28, 26, 24, 22 to shift to their open configurations. For example, the shear device 122 may be set to require 1250 psi to be applied to the line 36*a* to allow the valve 28 to open, the shear device 124 may be set to require 1750 psi to be applied to the line 36*a* to allow the valve 26 to open, the shear device 126 may be set to require 2250 psi to be applied to the line 36*a* to allow the valve 24 to open, and the shear device 128 may be set to require 2750 psi to be applied to the line 36*a* to allow the valve 22 to open.

Assuming the set opening pressures for the devices 68*a-d* given above, an exemplary series of steps for sequentially opening and closing the valves 22-28 would be as follows:

1. increase pressure in line 36*a* to greater than 1500 psi (but less than 1750 psi) to release shear device 122; then release the pressure from line 36*a* to open valve 28;

2. increase pressure in line 36*a* to greater than 2000 psi (but less than 2250 psi) to release shear device 124 and close valve 28; then decrease the pressure in line 36*a* to 1500 psi to open valve 26;

3. increase pressure in line 36*a* to greater than 2500 psi (but less than 2750 psi) to release shear device 126 and close valves 26, 28; then decrease the pressure in line 36*a* to 2000 psi to open the valve 24; and 4. increase pressure in line 36*a* to greater than 3000 psi to release shear device 128 and close valves 24, 26, 28; then decrease the pressure in line 36*a* to 2500 psi to open the valve 22.

It will be readily appreciated that the result of step 1 is that valve 28 is opened and the other valves 22, 24, 26 are closed (at which point the interval set 18 may be selectively stimulated, tested, produced, injected into, etc.), the result of step 2 is that valve 26 is opened and the other valves 22, 24, 28 are closed (at which point the interval set 16 may be selectively stimulated, tested, produced, injected into, etc.), the result of step 3 is that the valve 24 is opened and the other valves 22, 26, 28 are closed (at which point the interval set 14 may be selectively stimulated, tested, produced, injected into, etc.), and the result of step 4 is that valve 22 is opened and the other valves 24, 26, 28 are closed (at which point the interval set 12 may be selectively stimulated, tested, produced, injected into, etc.). Thus, the valves 22, 24, 26, 28 may be sequentially and selectively opened by manipulation of pressure on only one line 36*a*, thereby permitting selective and sequential fluid communication between the interior of the casing string 21 and each of the interval sets 12, 14, 16, 18.

After the stimulation operation is completed, all of the valves 22, 24, 26, 28 may be opened by releasing the pressure from the line 36*a*. If desired (for example, to perform testing of the interval sets 12, 14, 16, 18, control production from or injection into the interval sets, etc.), the valves 22, 24, 26, 28 may be sequentially closed by increasing the pressure on the line 36*a*.

Referring additionally now to FIGS. 10A-E, a valve 130 which may be used for any of the valves 22, 24, 26, 28 in the well system 10 and method of FIG. 1 is representatively illustrated. The valve 130 may also be used in other well systems and methods in keeping with the principles of the invention.

The valve 130 is similar in many respects to the valve 80 of FIG. 4, in that it includes chambers 132, 134 on opposite sides of a sleeve 136 having openings 138 in a sidewall thereof, and with pistons 140, 142 exposed to the respective chambers 132, 134 on opposite sides of the openings. The sleeve 136 is reciprocably received in a housing assembly 144 in a manner which isolates the openings 138 from the exterior and interior of the valve 130 when the sleeve is in its closed position. When the sleeve 136 is in its open position (as depicted in FIGS. 10A-E), the openings 138 are aligned with openings 146 formed through a sidewall of the housing assembly 144 to thereby permit fluid communication between the interior and exterior of the valve 130.

However, the valve 130 differs from the valve 80 in at least one significant respect, in that the valve 130 includes snap release mechanisms 148, 150 on opposite sides of the sleeve 136. These release mechanisms 148, 150 permit control over the pressure differential at which the sleeve 136 displaces between its open and closed positions, as described more fully below.

When used in the well system 10, a port 152 on the valve 130 would be connected to one of the lines 36 (such as line 36*a*) for delivery of pressurized fluid to bias the valve toward its open configuration. The port 152 is in communication with the chamber 132. Another of the lines 36 (such as line 36*b*) would be connected to another port 154 on the valve 130 for delivery of pressurized fluid to bias the valve toward its closed configuration. The port 154 is in communication with the chamber 134.

Each of the snap release mechanisms 148, 150 includes a stack of spring washers 156, release slide 158, capture slide 160, spring 162 and a set of collet fingers 164 attached to the sleeve 136. Briefly, when the collet fingers 164 displace toward and engage the remainder of one of the mechanisms 148, 150, the collet fingers (and the attached sleeve 136) are "captured" and cannot displace in the opposite direction until a sufficient releasing force is applied to release the collet fingers from the remainder of the mechanism. The amount of the releasing force corresponds to a differential pressure between the chambers 132, 134 (and the connected lines 36*a*, 36*b*).

With the valve 130 in its open configuration as depicted in FIGS. 10A-E, the upper collet fingers 164 are disengaged from the upper set of release slide 158 and capture slide 160 of the upper mechanism 148. However, when the sleeve 136 displaces upward toward its closed position, the collet fingers 164 will eventually contact the capture slide 160 and displace it upward against a biasing force exerted by the spring 162.

Further upward displacement of the collet fingers 164 and capture slide 160 will allow an inwardly facing projection 166 on each collet finger to "snap" into an annular recess 168 formed on the release slide 158. When this happens, the collet fingers 164 will displace radially inward sufficiently to allow the capture slide 160 to displace downwardly over the ends of the collet fingers, thereby "capturing" the collet fingers (i.e., preventing the projections 166 on the collet fingers from disengaging from the recess 168).

Figure 10A:
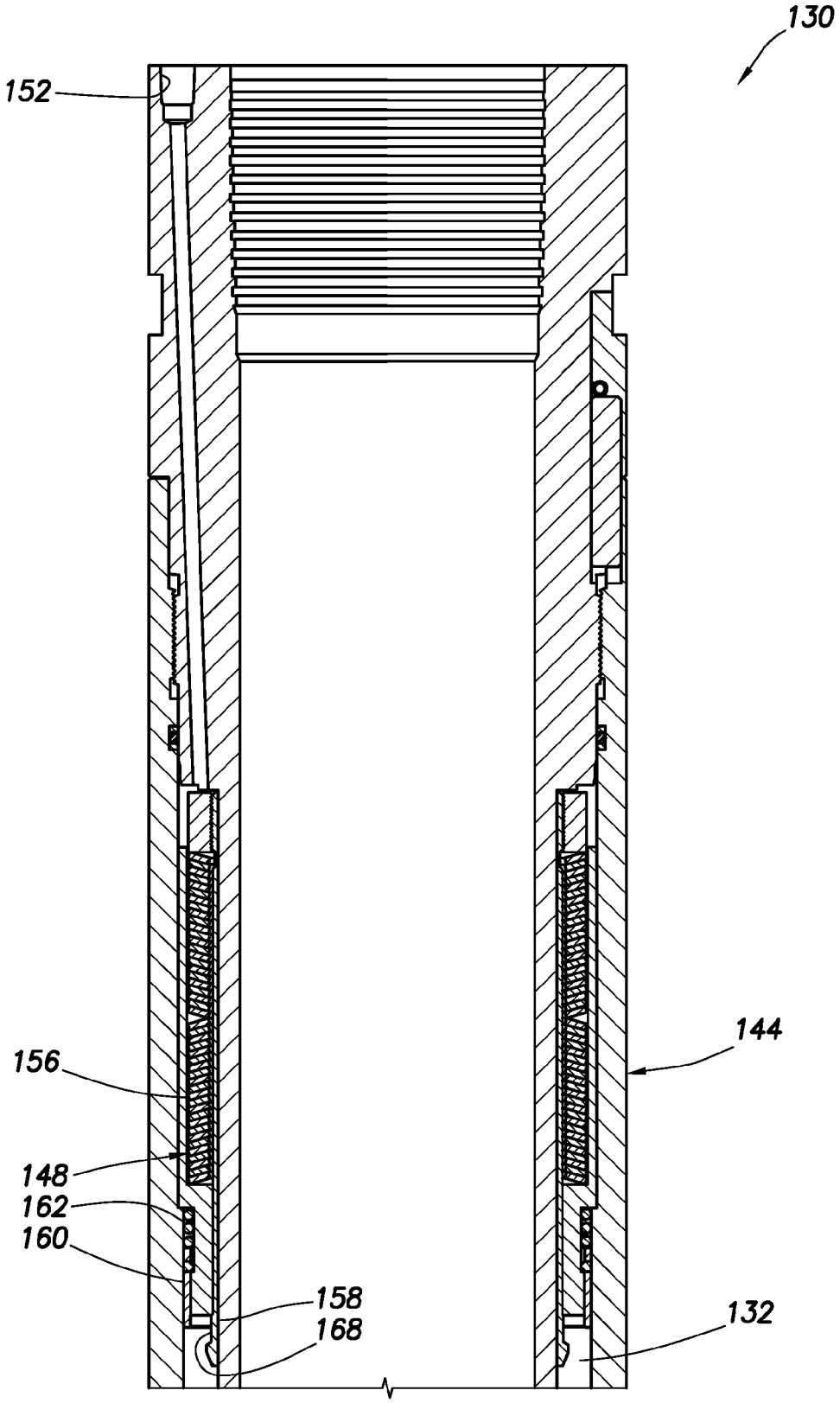
FIGS. 10A-E are schematic cross-sectional views of successive axial sections of a second alternate construction of a valve which may be used in the well system and method of FIG. 1.
Figure 10C:
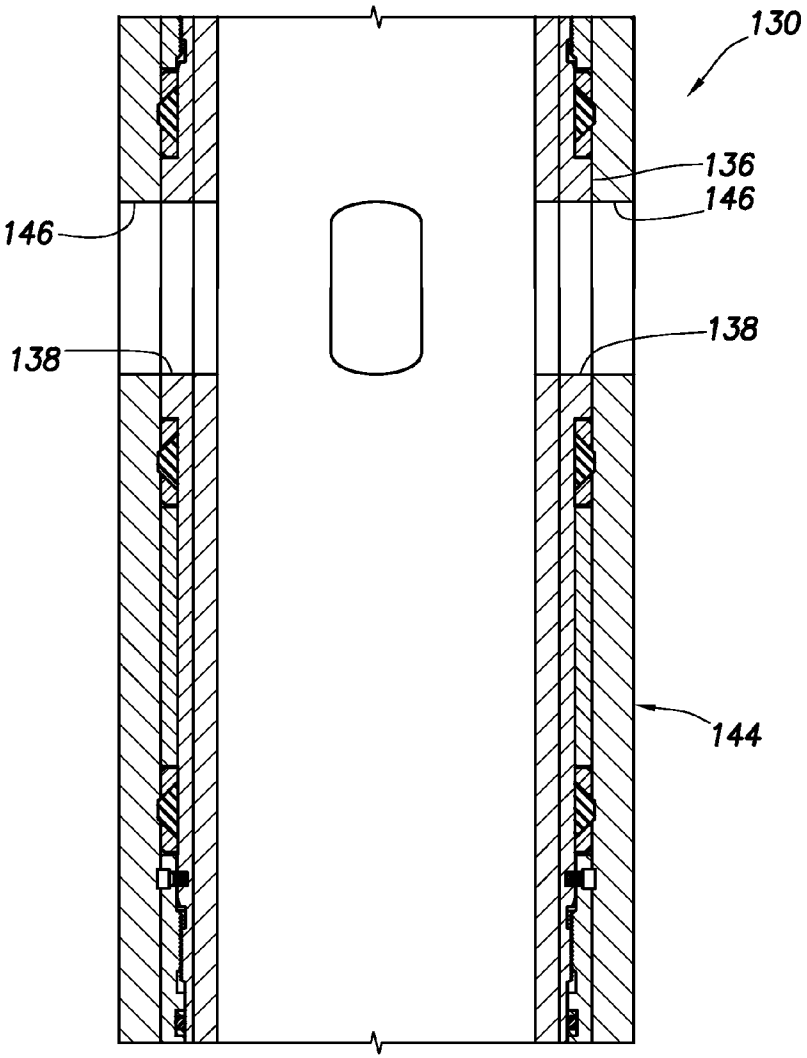
Figure 10B:
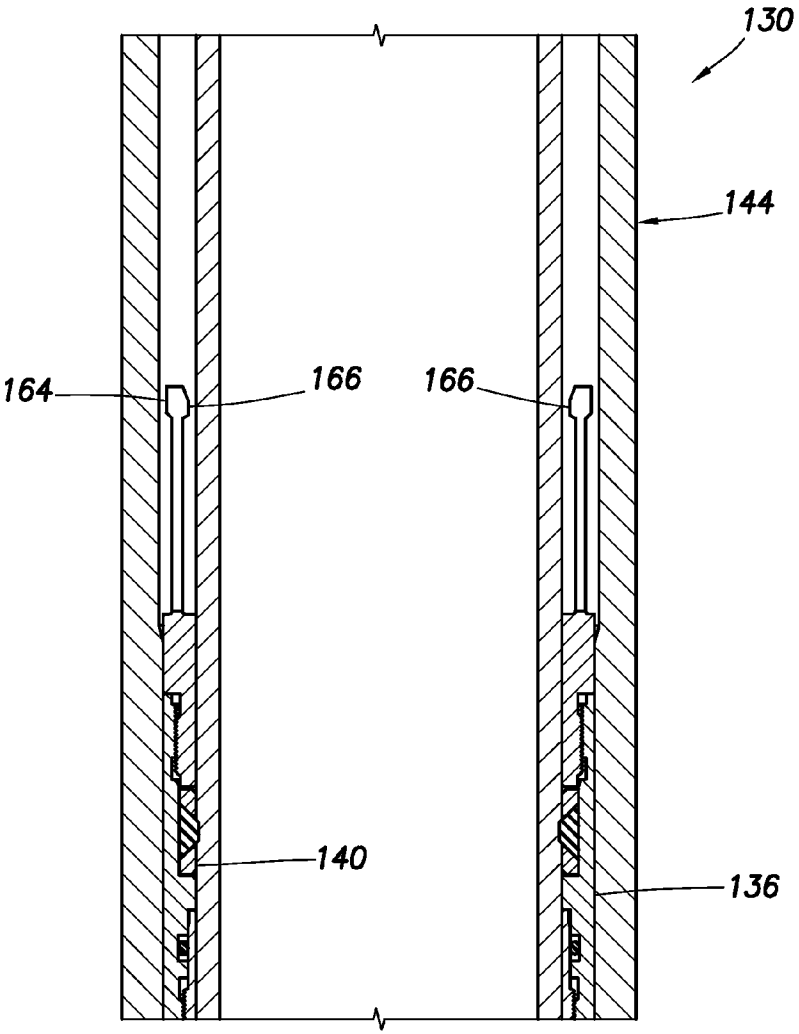
Figure 10D:
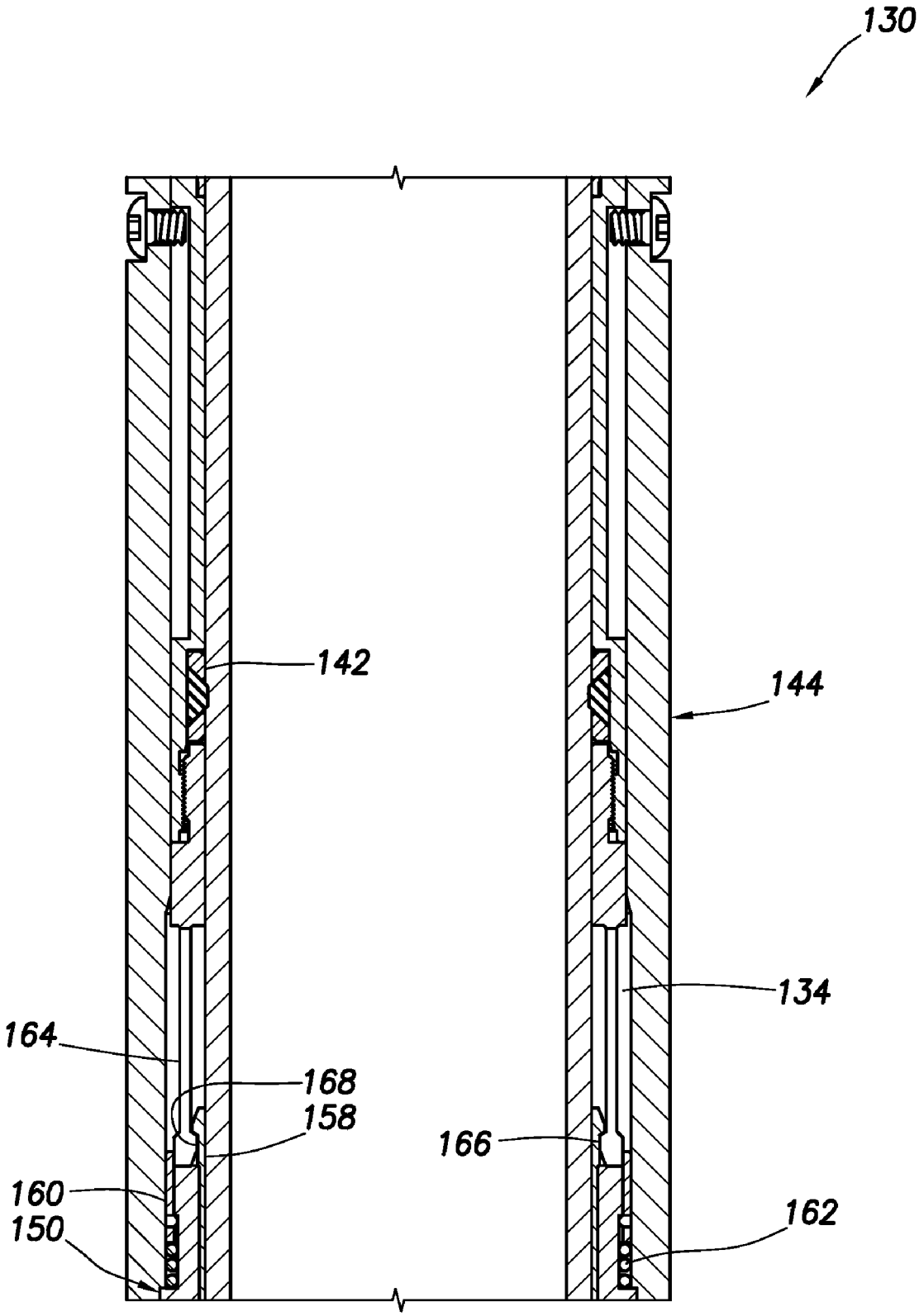
Figure 10E:
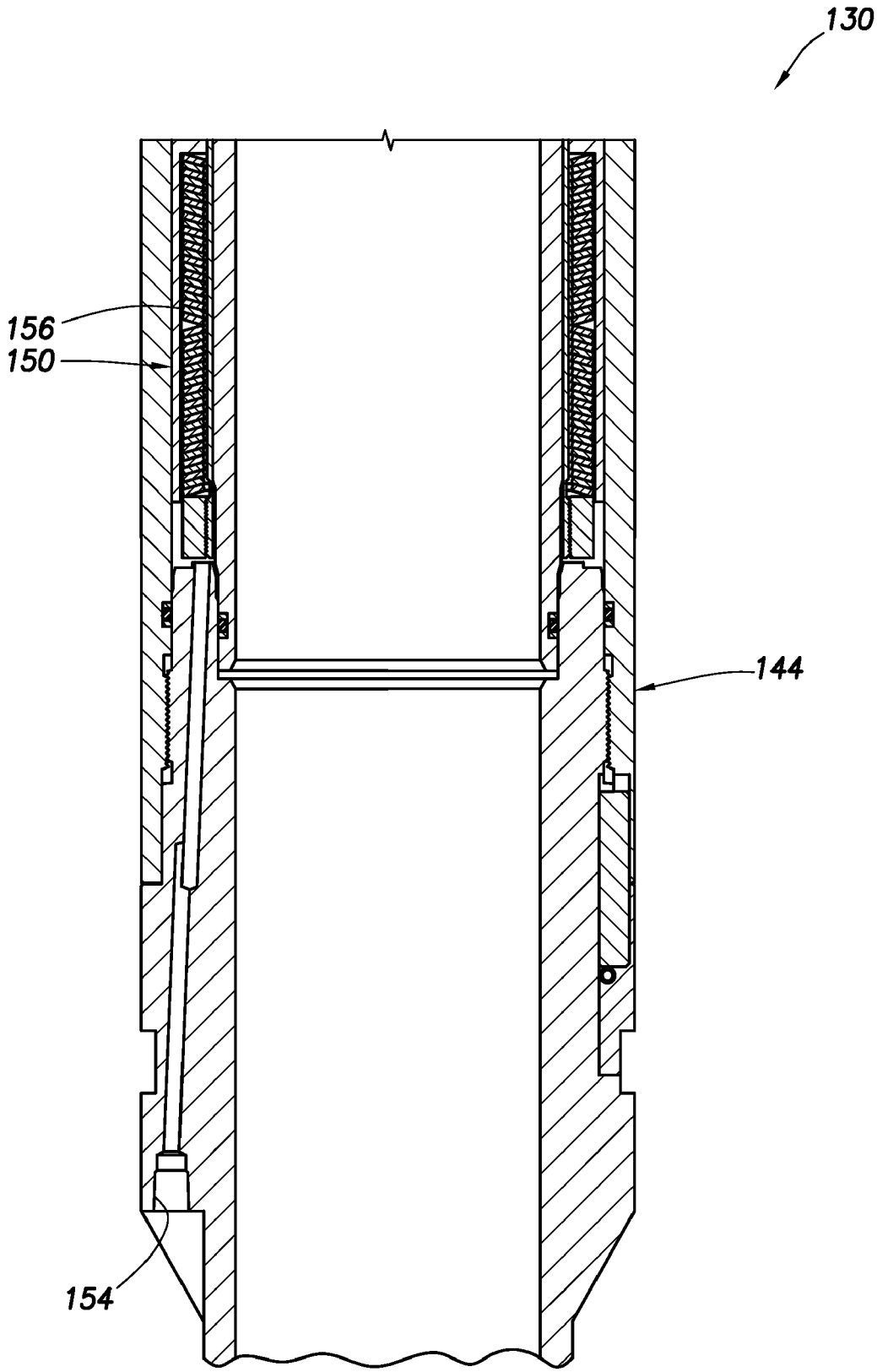

The collet fingers 164 are shown in this engaged configuration in the lower snap release mechanism 150 in FIG. 10D. To release the collet fingers 164, a sufficient tensile force must be applied to the collet fingers to displace the release slide 158 against the biasing force exerted by the spring washers 156. Thus, the force required to permit displacement of the sleeve 136 is directly related to the force exerted by the spring washers 156, and corresponds to the differential pressure between the chambers 132, 134.

The biasing force exerted by the spring washers 156 may be adjusted by varying a preload applied to the spring washers, varying a configuration of the spring washers, varying a material of the spring washers, varying a number of the spring washers, etc. Therefore, it will be appreciated that the force required to release the collet fingers 164 can be readily adjusted, thereby permitting the pressure differential required to displace the sleeve 136 between its open and closed positions to be readily adjusted, as well.

When the valve 130 is used for each of the valves 22, 24, 26, 28 in the well system 10, the hydraulic circuit would be very similar to the hydraulic circuit 100 of FIG. 5, except that the devices 68*a-d* would not be used, since the snap release mechanisms 148, 150 would permit the opening and closing pressure differentials of each valve to be controlled.

For example, valve 28 could be set to open at 1500 psi differential pressure from line 36*a* to line 36*b* (i.e., the sleeve 136 would be released by the upper mechanism 148 for downward displacement to its open position when pressure in the chamber 132 exceeds pressure in the chamber 134 by 1500 psi) and set to close at 1500 psi differential pressure from line 36*b* to line 36*a* (i.e., the sleeve would be released by the lower mechanism 150 for upward displacement to its closed position when pressure in the chamber 134 exceeds pressure in the chamber 132 by 1500 psi), valve 26 could be set to open at 2000 psi differential pressure from line 36*a* to line 36*b* and set to close at 2000 psi differential pressure from line 36*b* to line 36*a*, valve 24 could be set to open at 2500 psi differential pressure from line 36*a* to line 36*b* and set to close at 2500 psi differential pressure from line 36*b* to line 36*a*, and valve 22 could be set to open at 3000 psi differential pressure from line 36*a* to line 36*b* and set to close at 3000 psi differential pressure from line 36*b* to line 36*a*.

In this manner, differential pressure between the lines 36*a*, 36*b* may be used to selectively and sequentially open and close the valves 22, 24, 26, 28. Note that it is not necessary for the opening and closing pressure differentials to be the same in any of the valves.

Figure 11:
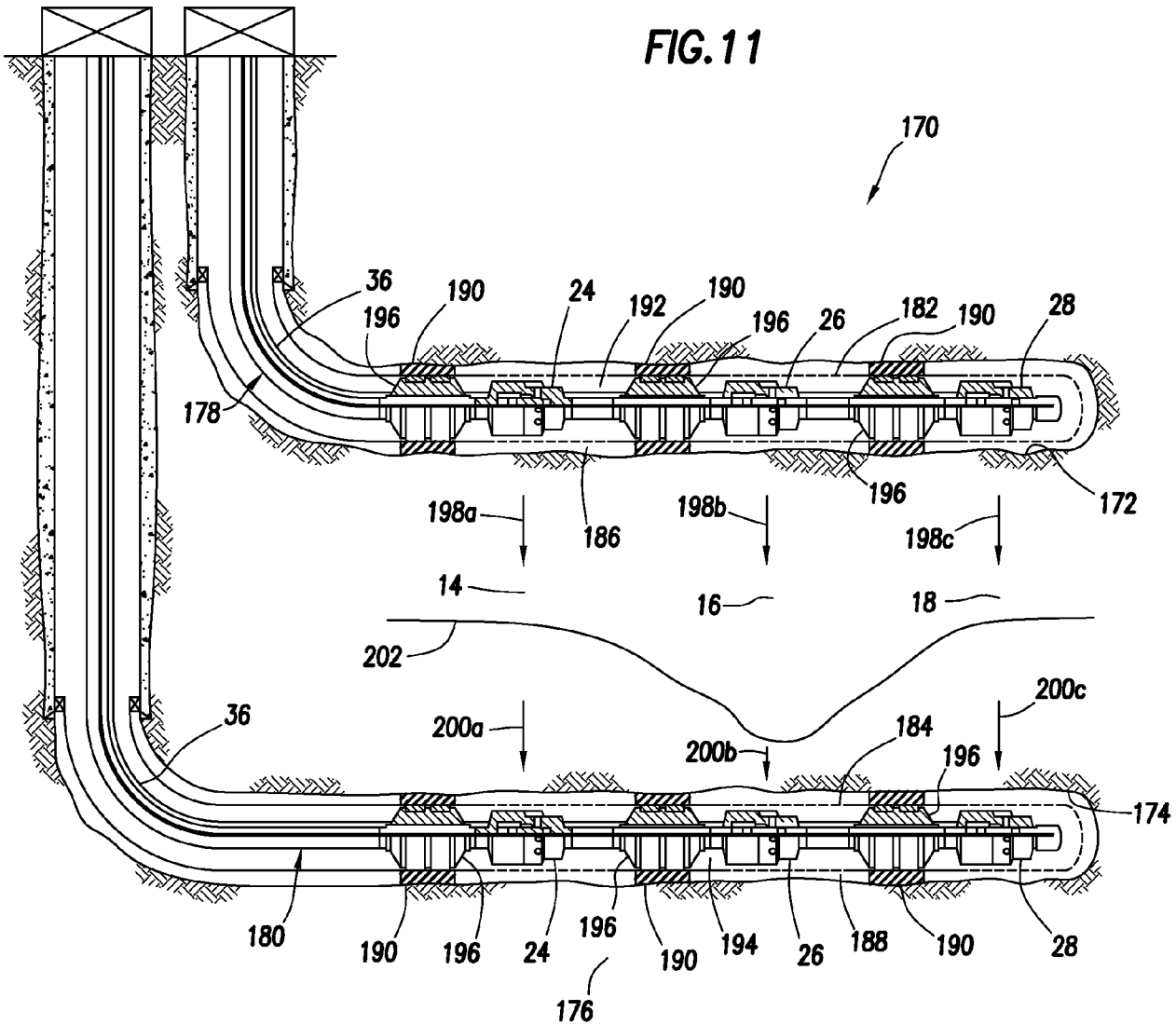
FIG. 11 is a schematic partially cross-sectional view of another well system and associated method which embody principles of the present invention.

Referring additionally now to FIG. 11, another well system 170 and associated method incorporating principles of the invention are representatively illustrated. The well system 170 is similar in some respects to the well system 10 described above, and so similar elements have been indicated in FIG. 11 using the same reference numbers.

The well system 170 includes two wellbores 172, 174. Preferably, the wellbore 174 is positioned vertically deeper in the formation 176 than the wellbore 172. In the example depicted in FIG. 11, the wellbore 172 is directly vertically above the wellbore 174, but this is not necessary in keeping with the principles of the invention.

A set of valves 24, 26, 28 and lines 36 is installed in each of the wellbores 172, 174. The valves 24, 26, 28 are preferably interconnected in tubular strings 178, 180 which are installed in respective perforated liners 182, 184 positioned in open hole portions of the respective wellbores 172, 174. Although only three of the valves 24, 26, 28 are depicted in each wellbore in FIG. 11, any number of valves may be used in keeping with the principles of the invention.

The interval sets 14, 16, 18 are isolated from each other in an annulus 186 between the perforated liner 182 and the wellbore 172, and in an annulus 188 between the perforated liner 184 and the wellbore 174, using a sealing material 190 placed in each annulus. The sealing material 190 could be any type of sealing material (such as swellable elastomer, hardenable cement, selective plugging material, etc.), or more conventional packers could be used in place of the sealing material.

The interval sets 14, 16, 18 are isolated from each other in an annulus 192 between the tubular string 178 and the liner 182, and in an annulus 194 between the tubular string 180 and the liner 184, by packers 196.

In the well system 170, steam is injected into the interval sets 14, 16, 18 of the formation 176 via the valves 24, 26, 28 in the wellbore 172, and formation fluid is received from the formation into the valves 24, 26, 28 in the wellbore 174. Steam injected into the interval sets 14, 16, 18 is represented in FIG. 11 by respective arrows 198*a*, 198*b*, 198*c*, and formation fluid produced from the interval sets is represented in FIG. 11 by respective arrows 200*a*, 200*b*, 200*c*.

The valves 24, 26, 28 in the wellbores 172, 174 are used to control an interface profile 202 between the steam 198*a-c* and the formation fluid 200*a-c*. By controlling the amount of steam injected into each interval set, and the amount of formation fluid produced from each interval set, a shape of the profile 202 can also be controlled.

For example, if the steam is advancing too rapidly in one of the interval sets (as depicted in FIG. 11 by the dip in the profile 202 in the interval set 16), the steam injected into that interval set may be shut off or choked, or production from that interval set may be shut off or choked, to thereby prevent steam breakthrough into the wellbore 174, or at least to achieve a desired shape of the interface profile.

In the example of FIG. 11, the valve 26 in the wellbore 172 could be selectively closed or choked to stop or reduce the flow of the steam 198*b* into the interval set 16. Alternatively, or in addition, the valve 26 in the wellbore 174 could be selectively closed or choked to stop or reduce production of the formation fluid 200*b* from the interval set 16.

Any of the valves 50, 80, 130 described above may be used for the valves 24, 26, 28 in the well system 170. For steam injection purposes in the wellbore 172, the valves 24, 26, 28 (as well as the seal material 190 and packers 196) should preferably be provided with appropriate heat resistant materials and constructed to withstand large temperature variations. For example, the packers 196 in the wellbore 172 could be of the type known as ring seal packers.

Figure 12:
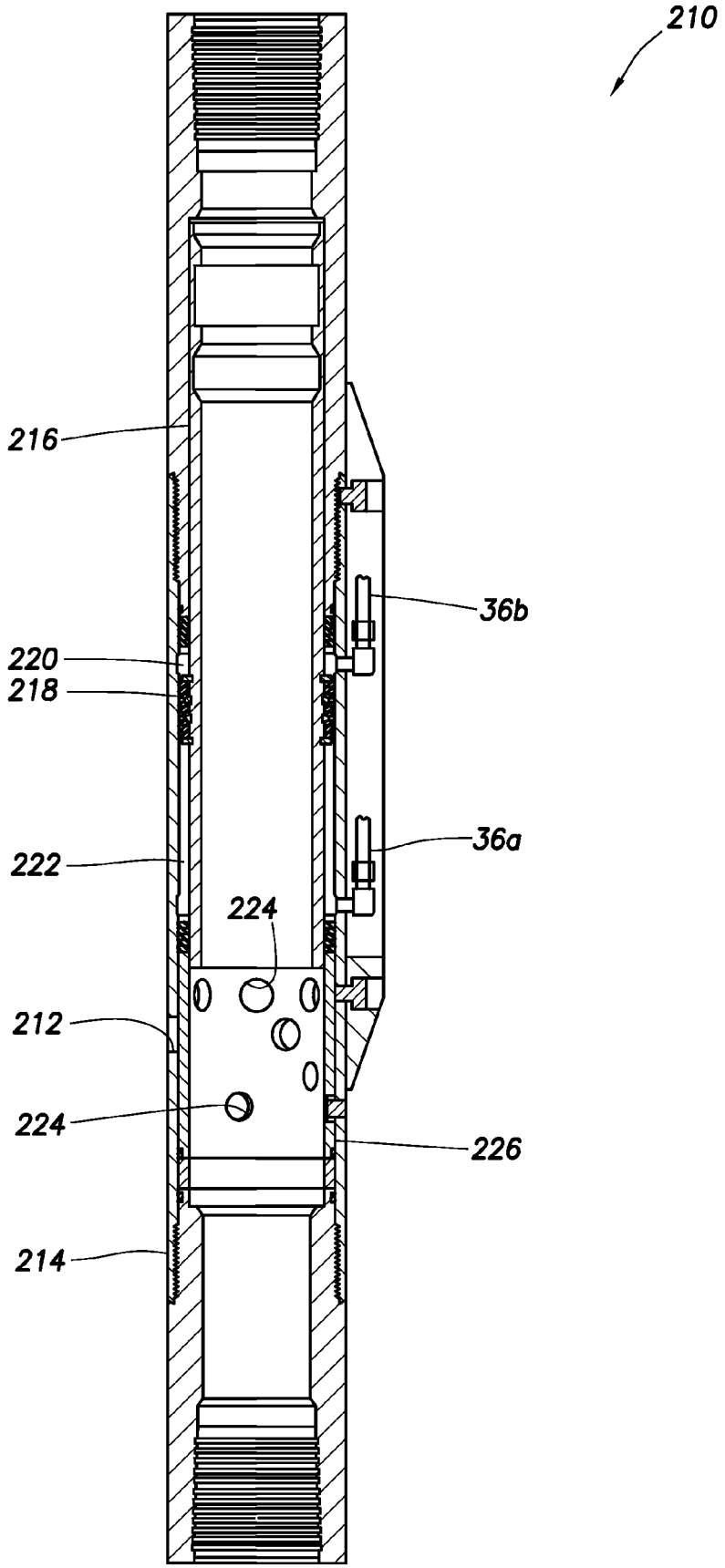
FIG. 12 is a schematic cross-sectional view of a valve which may be used in the well system and method of FIG. 11.

Referring additionally now to FIG. 12, another valve 210 which is especially suitable for use in high temperature applications is representatively illustrated.

The valve 210 may be used for any of the valves 22, 24, 26, 28 described above, and may be used in any well system in keeping with the principles of the invention.

The valve 210 may be more accurately described as a choke, since it is capable of variably regulating a rate of fluid flow through openings 212 formed through a sidewall of its housing assembly 214. The valve 210 includes a sleeve 216 having a piston 218 thereon which separates two chambers 220, 222. In this respect, the valve 210 is somewhat similar to the valve 50 of FIG. 2.

However, the sleeve 216 of the valve 210 is reciprocably displaced in the housing assembly 214 relative to openings 224 formed through a sidewall of a choke sleeve 226. Each of the openings 224 is in communication with the openings 212 in the housing assembly 214. As more of the openings 224 are covered by a lower end of the sleeve 216, flow through the openings 212 is increasingly choked or reduced.

Thus, by varying the volume of the chambers 220, 222 via fluid delivered through the lines 36*a*, 36*b*, the sleeve 216 may be positioned as desired to produce a selected flow rate of fluid through the openings 212. In the well system 170, this ability to variably choke the flow rate through the valve 210 may be useful to variably regulate the injection of steam into each of the interval sets 14, 16, 18, or to variably regulate the production of fluid from each of the interval sets.

Seals used in the valve 210 may be similar to the seals described in International Application No. PCT/US07/60648, filed Jan. 17, 2007, the entire disclosure of which is incorporated herein by this reference. The seals described in the incorporated application are especially suited for high temperature applications.

It may now be fully appreciated that the present invention provides many benefits over prior well systems and methods for selectively stimulating wells and controlling flow in wells. Sequential and selective control of multiple valves is provided, without requiring intervention into a casing or other tubular string, and certain valves are provided which are particularly suited for being cemented along with a casing string, or use in high temperature environments, etc. Certain important features of the well systems and methods described above are listed below:

The well system 10 includes one or more valves 22, 24, 26, 28 interconnected in the casing string 21, the valves being operable via at least one line 36 external to the casing string to thereby selectively permit and prevent fluid flow between an exterior and an interior of the casing string. The casing string 21, valves 22, 24, 26, 28 and line 36 are cemented in the wellbore 20.

The line 36 may be a hydraulic line, and the valves 22, 24, 26, 28 may be operable in response to manipulation of pressure in the line.

The valves 22, 24, 26, 28 may be cemented in the wellbore 20 in a closed configuration and subsequently operable to an open configuration to permit fluid flow between the interior and exterior of the casing string 21.

The valves 22, 24, 26, 28 may be cemented in the wellbore 20 in a closed configuration and subsequently operable to an open configuration to permit fluid flow between the interior and exterior of the casing string 21, and from the open configuration the valves may be subsequently operable to a closed configuration to prevent fluid flow between the interior and exterior of the casing string.

At least one opening 40 in a sidewall of each of the valves 22, 24, 26, 28 may contain a soluble cement 32 when the valve is cemented in the wellbore 20. The cement 32 may be an acid soluble cement.

The valves 22, 24, 26, 28 may be operable without intervention into the casing string 21. The valves 22, 24, 26, 28 may be operable without manipulation of pressure within the casing string 21.

Multiple valves 22, 24, 26, 28 may be interconnected in the casing string 21 and operable to thereby selectively permit and prevent fluid flow between the exterior and interior of the casing string. The valves 22, 24, 26, 28 may be sequentially operable via at least one of the lines 36 to thereby selectively permit and prevent fluid communication between the interior of the casing string 21 and respective subterranean interval sets 12, 14, 16, 18 intersected by the wellbore 20.

Multiple lines 36 may be connected to the valves 22, 24, 26, 28, and a first pressure differential between first and second lines may be used to operate one valve, and a second pressure differential between the first and second lines greater than the first pressure differential may be used to operate another one of the valves.

Alternatively, the valves 22, 24, 26, 28 may be operable via only one line to both open and close the multiple valves.

The valves 22, 24, 26, 28 may include the sleeves 82, 136 having the openings 88, 138 therein. The sleeves 82, 136 may be displaceable to thereby selectively permit and prevent fluid flow between the exterior and interior of the casing string 21, with the openings 88, 138 being isolated from cement 32 when the valves are cemented in the wellbore 20.

A pressure differential between lines 36*a*, 36*b* connected to the valves 22, 24, 26, 28 may be operable to displace the sleeves 82, 136 between open and closed positions. The openings 88, 138 may be positioned between a piston 98, 140 exposed to pressure in the line 36*a* and a second piston 96, 142 exposed to pressure in the second line. The valves 22, 24, 26, 28 may include one or more snap release mechanism 148, 150 which require that predetermined pressure differentials be applied in the valve to displace the sleeve 136 between open and closed positions.

Valves 80, 130 for use in a tubular string in a subterranean well are also described above. The valves 80, 103 may include the sleeves 82, 136 having first and second opposite ends, with the sleeve being displaceable between open and closed positions to thereby selectively permit and prevent flow through a sidewall of the housing assemblies 84, 144. First and second pistons 94, 96, 140, 142 are at the respective first and second ends of the respective sleeves 82, 136. Pressure differentials applied to the first and second pistons 94, 96, 140, 142 are operative to displace the sleeves 82, 136 between their open and closed positions.

At least one opening 88, 138 may extend through a sidewall of the sleeves 82, 136, and the openings may be isolated from the exteriors of the housing assemblies 84, 144 and the internal flow passages of the housings when the sleeves are in their closed positions. The openings 88, 138 may be positioned longitudinally between the first and second pistons 94, 96, 140, 142.

The first and second pistons 94, 96, 140, 142 may be exposed to pressure in respective first and second chambers 92, 94, 132, 134 at the respective first and second ends of the sleeves 82, 136. The sleeves 82, 136 may displace into the first chambers 92, 132 when the sleeves displace to their open positions, and the sleeves may displace into the second chambers 94, 134 when the sleeves displace to their closed positions.

An outer external diameter of each sleeve 82, 136 may sealingly engage an outer internal diameter of the respective first chamber 92, 132, and an inner external diameter of each sleeve may sealingly engage an inner internal diameter of the respective first chamber. Inner and outer walls of the housing assemblies 84, 144 may be positioned on opposite radial sides of the first and second chambers 92, 94, 132, 134, and the inner and outer walls may also be positioned on opposite radial sides of the sleeves 82, 136.

A first pressure differential between the first and second chambers 92, 94, 132, 134 may bias the sleeves 82, 136 to displace to their open positions. A second pressure differential between the first and second chambers 92, 94, 132, 134 may bias the sleeves 82, 136 to displace to their closed positions.

Methods of selectively stimulating the formation 176 are also provided. For example, the method may include the step of positioning the casing string 21 in the wellbore 20 intersecting the formation 176, with the casing string including multiple spaced apart valves 22, 24, 26, 28 operable to selectively permit and prevent fluid flow between an interior and an exterior of the casing string, the valves being operable via one or more lines 36 connected to the valves. The method may further include the step of, for each of the multiple sets of one or more intervals 12, 14, 16, 18 of the formation 176 in sequence, stimulating the interval set by opening a corresponding one of the valves 22, 24, 26, 28, closing the remainder of the valves, and flowing the stimulation fluid 30 from the interior of the casing string 21 and into the interval set.

The method may further include the step of, prior to the stimulating step, cementing the casing string 21 and lines 36 in the wellbore 20. The lines 36 may be positioned external to the casing string 21 during the cementing step.

The valve opening and closing steps may be performed by manipulating pressure in the lines 36. The opening and closing steps may be performed without intervention into the casing string 21. The opening and closing steps may be performed without application of pressure to the casing string 21.

Multiple lines 36 may be connected to the valves 22, 24, 26, 28, and the opening and closing steps may include manipulating pressure differentials between the lines.

The stimulation fluid flowing step may include fracturing the formation 176 at any of the interval sets 12, 14, 16, 18. The method may also the step of, for each of the interval sets 12, 14, 16, 18 in sequence, testing the interval set by opening the corresponding one of the valves 22, 24, 26, 28, closing the remainder of the valves, and flowing a formation fluid from the interval set and into the interior of the casing string 21. The testing step may be performed after the stimulating step.

Another method may include the steps of: positioning the tubular string 178 in the wellbore 172 intersecting the formation 176, the tubular string including multiple spaced apart valves 24, 26, 28 operable to selectively permit and prevent fluid flow between an interior and an exterior of the tubular string; positioning the tubular string 180 in the wellbore 174 intersecting the formation, the tubular string including multiple spaced apart valves 24, 26, 28 operable to selectively permit and prevent fluid flow between an interior and an exterior of the tubular string; and, for each of multiple sets of one or more intervals 14, 16, 18 of the formation, stimulating the interval set by opening a corresponding one of the valves in the wellbore 172, flowing a stimulation fluid from the interior of the tubular string 178 and into the interval set, opening a corresponding one of the valves in the wellbore 174, and in response receiving a formation fluid from the interval into the interior of the tubular string 180.

The valves 24, 26, 28 may be operable via one or more lines 36 connected to the valves. The lines 36 may be external to the tubular strings 178, 180 when they are positioned in the wellbores 172, 174.

The stimulation fluid may include steam.

The wellbore 174 may be located vertically deeper in the formation than the other wellbore 172.

The valve opening steps may be performed by manipulating pressure in respective lines 36*a*, 36*b* connected to the valves 24, 26, 28. The valve opening steps may be performed without intervention into the respective tubular strings 178, 180. The valve opening steps may be performed without application of pressure to the respective tubular strings 178, 180.

The method may include the steps of connecting multiple lines 36 to the valves 24, 26, 28 in the wellbore 172, and connecting multiple lines 36 to the valves in the wellbore 174, and the valve opening steps may include manipulating pressure differentials between individual ones 36*a*, 36*b* of the respective lines.

The method may further include the step of regulating advancement of the stimulation fluid toward the wellbore 174 by selectively restricting flow through at least one of the valves 24, 26, 28 in the wellbore.

The method may include the step of regulating advancement of the stimulation fluid toward the wellbore 174 by selectively restricting flow through at least one of the valves 24, 26, 28 in the other wellbore 172.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well system, comprising:

at least a first valve interconnected in a casing string, the first valve being operable via at least a first line external to the casing string to thereby selectively permit and prevent fluid flow between an exterior and an interior of the casing string, and the casing string, first valve and first line being cemented in a wellbore.

2. The well system of claim 1, wherein the first line is a hydraulic line, and wherein the first valve is operable in response to manipulation of pressure in the first line.

3. The well system of claim 1, wherein the first valve is cemented in the wellbore in a closed configuration and is subsequently operable to an open configuration to permit fluid flow between the interior and exterior of the casing string.

4. The well system of claim 1, wherein the first valve is cemented in the wellbore in a closed configuration and is subsequently operable to an open configuration to permit fluid flow between the interior and exterior of the casing string, and from the open configuration is subsequently operable to a closed configuration to prevent fluid flow between the interior and exterior of the casing string.

5. The well system of claim 1, wherein at least one opening in a sidewall of the first valve contains a soluble cement when the first valve is cemented in the wellbore.

6. The well system of claim 5, wherein the cement is an acid soluble cement.

7. The well system of claim 1, wherein the first valve is operable without intervention into the casing string.

8. The well system of claim 1, wherein the first valve is operable without manipulation of pressure within the casing string.

9. The well system of claim 1, further comprising a second valve interconnected in the casing string and operable to thereby selectively permit and prevent fluid flow between the exterior and interior of the casing string.

10. The well system of claim 9, wherein the first and second valves are sequentially operable via at least the first line to thereby selectively permit and prevent fluid communication between the interior of the casing string and respective first and second subterranean interval sets intersected by the wellbore.

11. The well system of claim 10, wherein the first line and at least a second line are connected to each of the first and second valves, and wherein a first pressure differential between the first and second lines operates the first valve, and a second pressure differential between the first and second lines greater than the first pressure differential operates the second valve.

12. The well system of claim 10, wherein the first and second valves are operable via only the first line to both open and close the first and second valves.

13. The well system of claim 1, wherein the first valve includes a sleeve having an opening therein, the sleeve being displaceable to thereby selectively permit and prevent fluid flow between the exterior and interior of the casing string, and wherein the opening is isolated from cement when the first valve is cemented in the wellbore.

14. The well system of claim 13, wherein a pressure differential between the first line and a second line connected to the first valve is operable to displace the sleeve between open and closed positions.

15. The well system of claim 14, wherein the opening is positioned between a first piston exposed to pressure in the first line and a second piston exposed to pressure in the second line.

16. The well system of claim 13, wherein the first valve includes at least one snap release mechanism which requires that a predetermined pressure differential be applied in the first valve to displace the sleeve between open and closed positions.

* * * * *